US011763746B1

(12) United States Patent
Zhang et al.

(10) Patent No.: US 11,763,746 B1
(45) Date of Patent: Sep. 19, 2023

(54) DISPLAY PANEL, METHOD FOR DRIVING THE SAME, AND DISPLAY APPARATUS

(71) Applicants: WUHAN TIANMA MICRO-ELECTRONICS CO., LTD., Wuhan (CN); Wuhan Tianma Microelectronics Co., Ltd. Shanghai Branch, Shanghai (CN)

(72) Inventors: Mengmeng Zhang, Wuhan (CN); Yue Li, Wuhan (CN)

(73) Assignees: WUHAN TIANMA MICRO-ELECTRONICS CO., LTD., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 0 days.

(21) Appl. No.: 18/056,911

(22) Filed: Nov. 18, 2022

(30) Foreign Application Priority Data

Sep. 2, 2022 (CN) ..... 202211072633.4

(51) Int. Cl.
*G09G 3/3233* (2016.01)

(52) U.S. Cl.
CPC ... *G09G 3/3233* (2013.01); *G09G 2300/0842* (2013.01); *G09G 2310/08* (2013.01); *G09G 2320/0247* (2013.01); *G09G 2330/026* (2013.01); *G09G 2330/027* (2013.01); *G09G 2330/04* (2013.01)

(58) Field of Classification Search
None
See application file for complete search history.

(56) References Cited

U.S. PATENT DOCUMENTS

2019/0325845 A1* 10/2019 Zhu ..... G09G 3/2074
2020/0388229 A1* 12/2020 Zhang ..... G09G 3/3266

FOREIGN PATENT DOCUMENTS

CN 113241035 A 8/2021

* cited by examiner

*Primary Examiner* — Christopher J Kohlman
(74) *Attorney, Agent, or Firm* — CHRISTENSEN O'CONNOR JOHNSON KINDNESS PLLC

(57) ABSTRACT

A display panel, a method for driving the same, and a display apparatus are provided. The display panel includes an emission driving circuit that includes cascaded emission driving units. The emission driving unit includes a control module including a control transistor. The control transistor provides a signal of an adjustment signal terminal to a first node in response to a signal of a first control signal terminal, so as to turn off a first output module. A voltage difference between any two of a control electrode, a first electrode or a second electrode of the control transistor is smaller than or equal to a preset threshold, and/or a duration in which a voltage difference between any two of the control electrode, the first electrode or the second electrode of the control transistor is greater than the preset threshold is smaller than or equal to a preset duration.

22 Claims, 13 Drawing Sheets

DISPLAY PANEL, METHOD FOR DRIVING THE SAME, AND DISPLAY APPARATUS

CROSS-REFERENCE TO RELATED APPLICATION

The present disclosure claims priority to Chinese Patent Application No. 202211072633.4, filed on Sep. 02, 2022, the content of which is incorporated herein by reference in its entirety.

TECHNICAL FIELD

The present disclosure relates to the field of display technologies, and in particular, to a display panel, a method for driving the display panel, and a display apparatus.

BACKGROUND

With continuous development of display technologies, consumers have increasing requirements for display screens. At present, various types of display screens, including liquid crystal display screen and organic light-emitting display screen, are emerging and developing rapidly. On this basis, display technologies such as 3D display technology, touch display technology, curved display technology, ultra-high-resolution display technology, and anti-peeping display technology are also emerging.

At present, the display panel has a flicker problem when the display panel is started up or shut down, which affects display quality.

SUMMARY

Various embodiments of the present disclosure provide a display panel, a method for driving the display panel, and a display apparatus for solving the flicker screen problem when the display panel is started up or shut down.

A first aspect of the present disclosure provides a display panel. The display panel includes an emission driving circuit. The emission driving circuit includes a plurality of emission driving units that is cascaded. Each of the plurality of emission driving units includes: an input terminal, an output terminal, a first clock signal terminal, a second clock signal terminal, a first level signal terminal, a second level signal terminal, a first node, a second node, adjustment signal terminal, and a first control signal terminal, a processing module, a first output module, and a control module.

The processing module is electrically connected to the input terminal, the first clock signal terminal, the second clock signal terminal, the first level signal terminal, the second level signal terminal, the first node and the second node, and is configured to provide a signal to the first node and the second node in response to a signal of the first clock signal terminal and a signal of the second clock signal terminal.

The first output module is electrically connected to the first node, the second level signal terminal and the output terminal, and is configured to transmit the signal of the second level signal terminal to the output terminal in response to the signal of the first node.

The control module includes a control transistor. The control transistor has a control electrode electrically connected to the first control signal terminal, a first electrode electrically connected to an adjustment signal terminal, and a second electrode electrically connected to the first node.

The control transistor is configured to transmit a signal of the adjustment signal terminal to the first node in response to the signal of the first control signal terminal, so as to turn off the first output module. A voltage difference between any two of the control electrode, the first electrode or the second electrode of the control transistor is smaller than or equal to a preset threshold, and/or a duration in which the voltage difference between any two of the control electrode, the first electrode or the second electrode of the control transistor is greater than the preset threshold is smaller than or equal to a preset duration.

A second aspect of the present disclosure provides a method for driving the above display panel. An operating process of the display panel includes a first stage and a second stage. The driving method includes: in the first stage, controlling the control transistor to be turned on, and providing a signal of the adjustment signal terminal to the first node; and in the second phase, controlling the control transistor to be turned off.

A third aspect of the present disclosure provides a display apparatus. The display apparatus includes a display panel mentioned above.

In the display panel provided by the embodiments of the present disclosure, the control module is arranged in the emission driving unit of the display panel, and the control module may adjust the operating state of the first output module. For example, when the display panel is started up and before the displaying of the first frame of image starts, or after the display panel is shutdown, the control module can provide the signal of the adjustment signal terminal to the first node in response to the signal of the first control signal terminal, and the signal of the adjustment signal terminal can turn off the first output module, thereby preventing the signal of the second level signal terminal electrically connected to the first output module from being outputted to the pixel driving circuit, and avoiding the light-emitting of the sub-pixel. That is, by using the display panel provided by the embodiments of the present disclosure, the flicker problem of the display panel when starting up can be effectively avoided, and the display effect of the display panel is improved.

Moreover, in the embodiments of the present disclosure, by designing the control transistor in the control module, the voltage difference between any two of the control electrode, the first electrode or the second electrode of the control transistor is smaller than or equal to a preset threshold, and/or, the duration in which the voltage difference between any two of the control electrode, the first electrode or the second electrode of the control transistor is greater than the preset threshold is smaller than or equal to a preset duration, so that the control transistor is prevented from being in a large bias state for a long time, thereby ensuring the stability of the control transistor.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings.

DESCRIPTION OF EMBODIMENTS

In order to better understand technical solutions of the present disclosure, the embodiments of the present disclosure are described in detail with reference to the drawings.

It should be clear that the described embodiments are merely part of the embodiments of the present disclosure rather than all of the embodiments. All other embodiments obtained by those skilled in the art shall fall into the protection scope of the present disclosure.

The terms used in the embodiments of the present disclosure are merely for the purpose of describing specific embodiment, rather than limiting the present disclosure. The terms "a", "an", "the" and "said" in a singular form in the embodiment of the present disclosure and the attached claims are also intended to include plural forms thereof, unless noted otherwise.

It should be understood that the term "and/or" used in the context of the present disclosure is to describe a correlation relation of related objects, indicating that there may be three relations, e.g., A and/or B may indicate only A, both A and B, and only B. In addition, the symbol "/" in the context generally indicates that the relation between the objects in front and at the back of "/" is an "or" relationship.

It should be understood that although the terms 'first', 'second' and 'third' may be used in the present disclosure to describe transistors, these transistors should not be limited to these terms. These terms are used only to distinguish the transistors from each other. For example, without departing from the scope of the embodiments of the present disclosure, a first transistor may also be referred to as a second transistor. Similarly, the second transistor may also be referred to as the first transistor.

Figure 1:
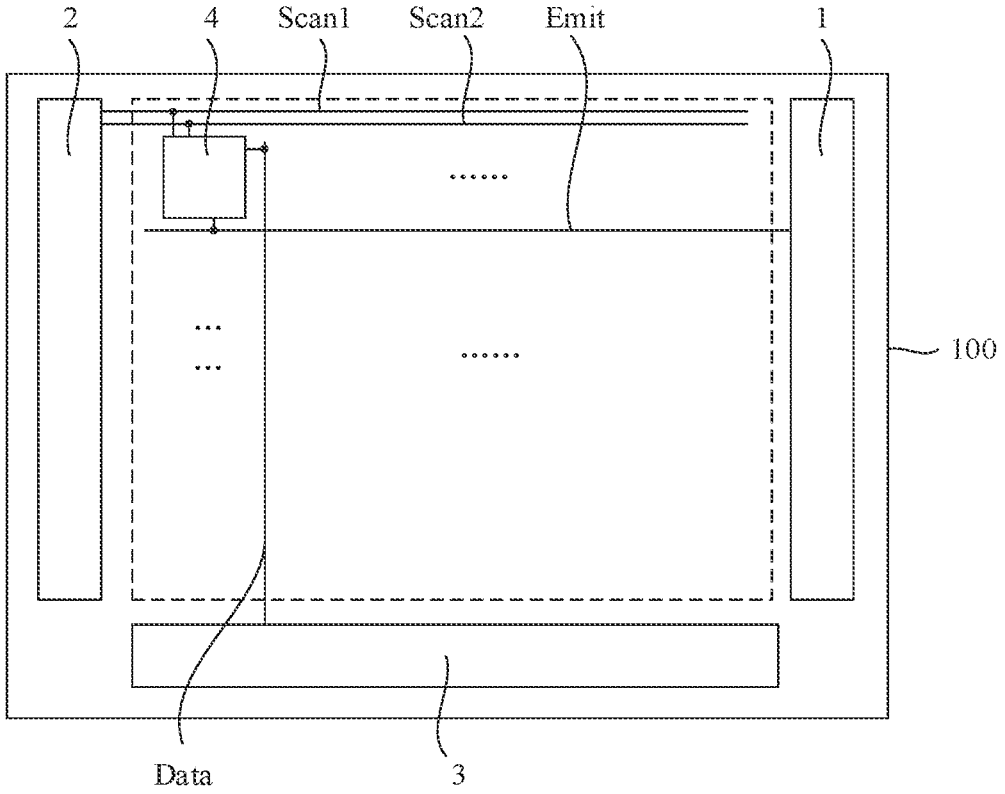
FIG. 1 is a schematic diagram of a display panel according to an embodiment of the present disclosure.

The present disclosure provides a display panel. As shown in FIG. 1, which is a schematic diagram of a display panel 100 according to an embodiment of the present disclosure, the display panel 100 includes an emission driving circuit 1, a scanning driving circuit 2, a data driving circuit 3 and multiple sub-pixels 4. The display panel 100 further includes a first scanning line Scan1, a second scanning line Scan2, a light-emitting control signal line Emit and a data line Data. The emission driving circuit 1 is electrically connected to the sub-pixels 4 through light-emitting control signal line Emit. The emission driving circuit 1 is configured to output a light-emitting control signal to the sub-pixel 4 to control the light-emitting state of the sub-pixel 4. The scanning driving circuit 2 is electrically connected to the sub-pixel 4 through the first scanning line Scan1 and the second scanning line Scan2. The data driving circuit 3 is electrically connected to the sub-pixel 4 through the data line Data.

Figure 2:
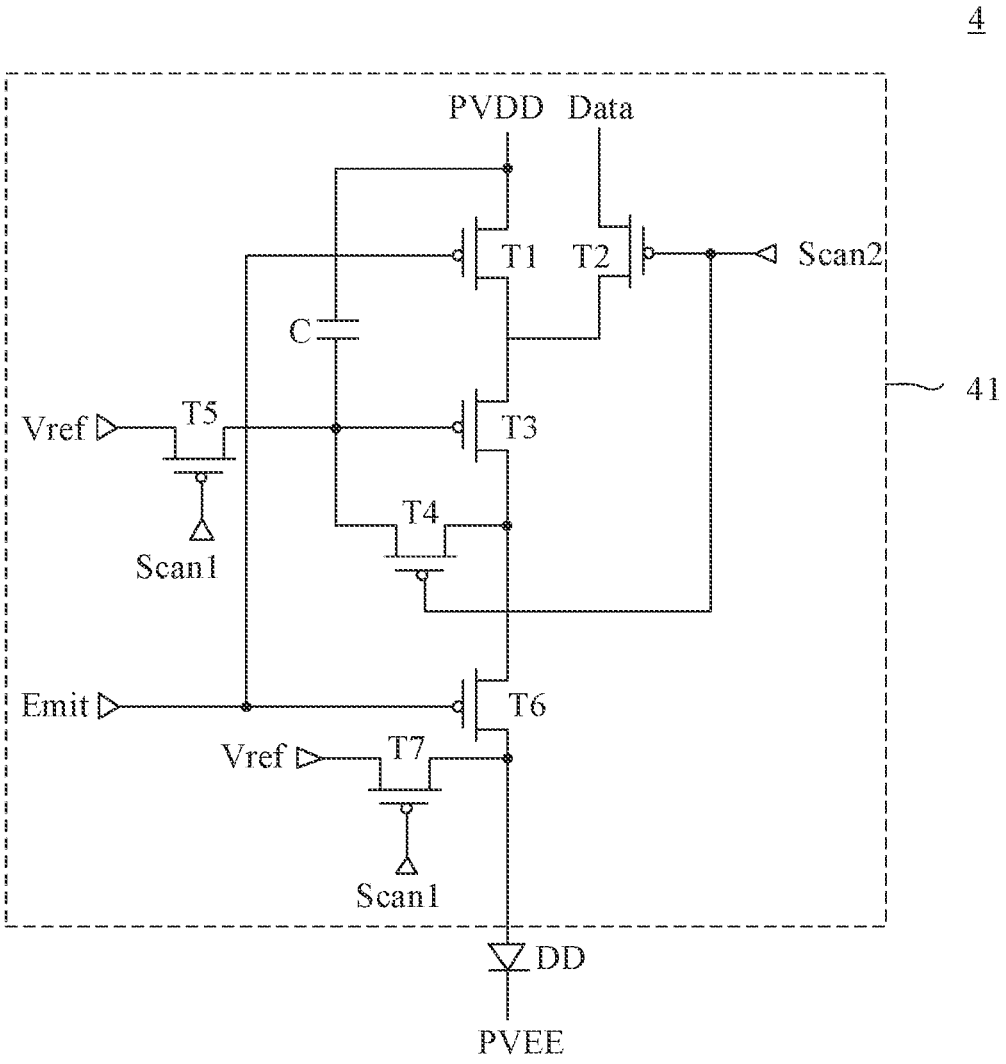
FIG. 2 is a schematic diagram of an equivalent circuit of a sub-pixel according to an embodiment of the present disclosure.

Exemplarily, as shown in FIG. 2, which is a schematic diagram of an equivalent circuit of the sub-pixel 4 according to an embodiment of the present disclosure, the sub-pixel 4 includes a pixel driving circuit 41 and a light-emitting element DD that are electrically connected to each other. Exemplarily, the light-emitting element DD may be any one of an organic light-emitting diode, an inorganic light-emitting diode, and a quantum dot light-emitting diode. As shown in FIG. 2, the pixel driving circuit 41 includes a storage capacitor C, and a first transistor T1 to a seventh transistor T7. In some embodiments of the present disclosure, the quantity of the transistors of the pixel driving circuit 41 in the sub-pixel 4 may be other numbers, which is not limited in the embodiments of the present disclosure.

Figure 3:
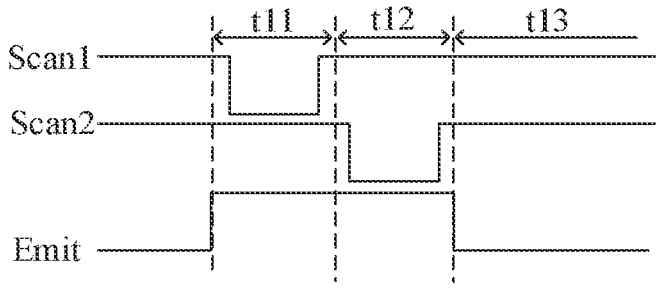
FIG. 3 is an operating timing diagram of a pixel driving circuit shown in FIG. 2 according to an embodiment of the present disclosure.

When the pixel driving circuit 41 is operating, referring to FIG. 3 which is an operating timing diagram of the pixel driving circuit 41 shown in FIG. 2 according to an embodiment of the present disclosure, during an initialization period t11, a first scanning driving signal provided by the first scanning line Scan1 is at low-level, a second scanning driving signal provided by the second scanning line Scan2 and a light-emitting control signal provided by the light-emitting control signal line Emit are at high-level, and a reference voltage signal provided by the reference voltage line Vref resets the voltage of the control electrode of the third transistor T3 through the turned-on fifth transistor T5, and resets the anode of the light-emitting element DD through the turned-on seventh transistor T7.

During a charging period t12, the second scanning driving signal provided by the second scanning line Scan2 is at low-level, and the first scanning driving signal provided by the first scanning line Scan1 and the light-emitting control signal provided by the light-emitting control signal line Emit are at high-level, the data signal provided by the data line Data is inputted into the control electrode of the third transistor T3 through the second transistor T2, the third transistor T3 and the fourth transistor T4 that are turned on.

In the light-emitting period t13, the light-emitting control signal provided by the light-emitting control signal line Emit is at low-level, and the first scanning driving signal provided by the first scanning line Scan1 and the second scanning driving signal provided by the second scanning line Scan2 are at high-level, the first transistor T1, the third transistor T3 and the sixth transistor T6 are turned on, a driving current flowing from a first power supply voltage terminal PVDD to a second power supply voltage terminal PVEE is generated, and the light-emitting element DD emits light under the action of the driving current.

Figure 4:
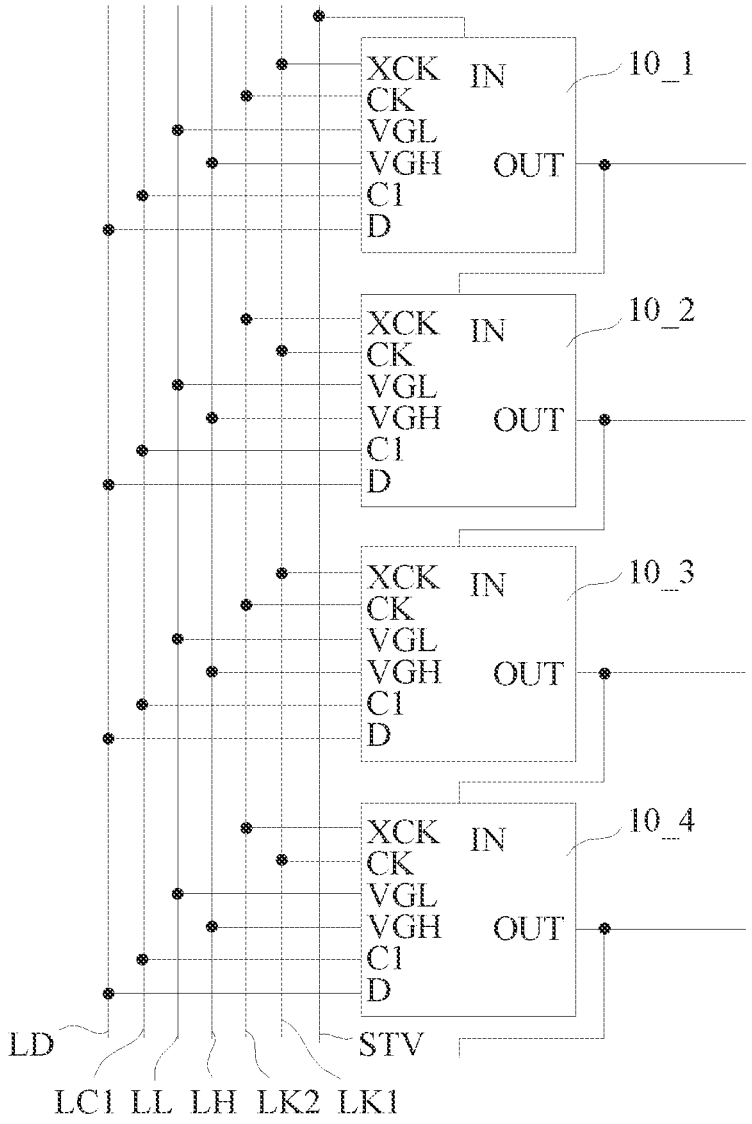
FIG. 4 is a schematic diagram of an emission driving circuit according to an embodiment of the present disclosure.

As shown in FIG. 4 which is a schematic diagram of an emission driving circuit 1 according to an embodiment of the present disclosure, the emission driving circuit 1 includes multiple cascaded emission driving units 10. In FIG. 4, the emission driving circuit 1 including a first-stage emission driving unit 10_1, a second-stage emission driving unit 10_2, a third-stage emission driving unit 10_3 and a fourth-stage emission driving unit 10_4 is shown as an illustration. Each stage of multiple cascaded emission driving units 10 includes an input terminal IN, an output terminal OUT, a first clock signal terminal XCK, a second clock signal terminal CK, a first level signal terminal VGH, and a second level signal terminal VGL. The emission driving unit 10 provides the light-emitting control signal to the pixel driving circuit through the output terminal OUT in response to a signal of the input terminal IN, a signal of the first clock signal terminal XCK, a signal of the second clock signal terminal CK, a signal of the first level signal terminal VGH, and a signal of the second level signal terminal VGL.

As shown in FIG. 4, the display panel further includes a first clock signal line LK1, a second clock signal line LK2, a second level signal line LL, a first level signal line LH, and a start signal line STV. The first clock signal line LK1 is electrically connected to the first clock signal terminals XCK of odd-numbered stages of emission driving units 10 and the second clock signal terminals CK of even-numbered stages of emission driving units 10 in the emission driving circuit 1 respectively. The second clock signal line LK2 is electrically connected to the second clock signal terminals CK of the odd-numbered stages of emission driving units 10 and the first clock signal terminals XCK of the even-numbered stages of emission driving units 10 in the emission driving circuit 1 respectively.

The first level signal line LH is electrically connected to the first level signal terminal VGH of each stage of emission driving unit 10 in the emission driving circuit 1, and the second level signal line LL is electrically connected to the second level signal terminal VGL of the each stage of emission driving unit 10 in the emission driving circuit 1. The voltage transmitted by the second level signal line LL is smaller than the voltage transmitted by the first level signal line LH.

The input terminal IN of the first-stage emission driving unit 10 is electrically connected to the start signal line STV, and the input terminal IN of each of other stages emission driving units 10 is electrically connected to a carry signal terminal or the output terminal OUT of the previous-stage emission driving unit 10. Hereinafter, the description is made with an example in which the input terminal IN of non-first-stage emission driving unit 10 is electrically connected to the output terminal OUT of the previous-stage emission driving unit 10.

Figure 5:
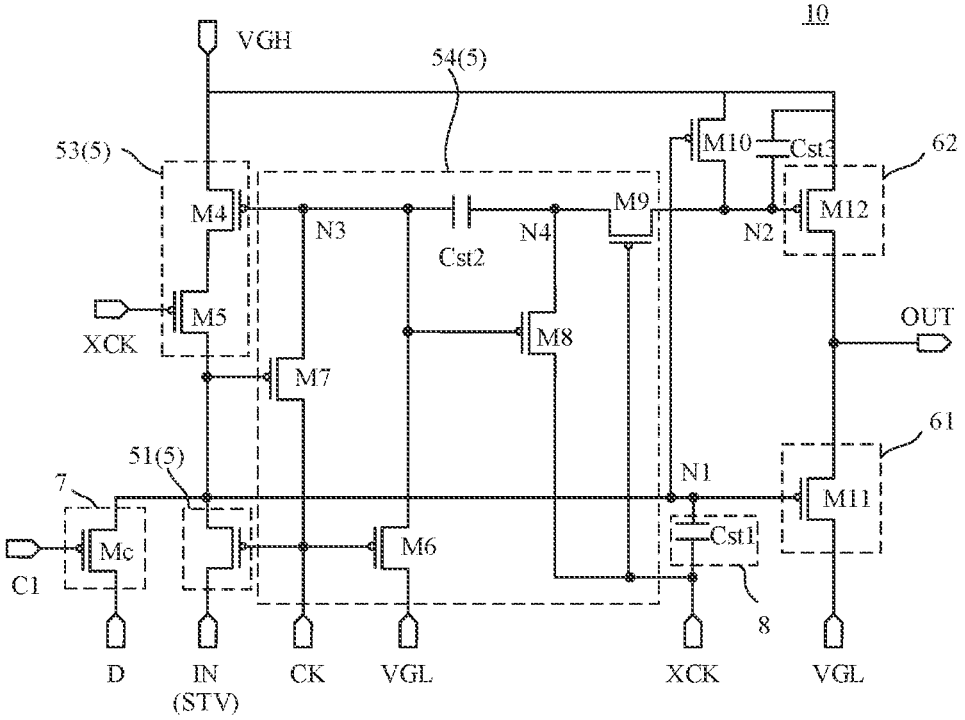
FIG. 5 is a schematic circuit diagram of an emission driving unit according to an embodiment of the present disclosure.

Exemplarily, as shown in FIG. 5 which is a schematic circuit diagram of an emission driving unit 10 according to an embodiment of the present disclosure, the emission driving unit 10 further includes: a processing module 5, a first output module 61, a second output module 62 and a control module 7. The processing module 5 is electrically connected to the input terminal IN, the first clock signal terminal XCK, the second clock signal terminal CK, the first level signal terminal VGH, the second level signal terminal VGL, the first node N1 and the second node N2. The processing module 5 is configured to provide signals to the first node N1 and the second node N2 in response to the signals of the first clock signal terminal XCK and the second clock signal terminal CK. The first output module 61 is electrically connected to the first node N1, the second level signal terminal VGL and the output terminal OUT. The first output module 61 is configured to provide the signal of the second level signal terminal VGL to the output terminal OUT in response to the signal of the first node N1. The output terminal OUT is electrically connected to the light-emitting control signal line Emit. The second output module 62 is electrically connected to the second node N2, the first level signal terminal VGH and the output terminal OUT of the emission driving unit 10. The second output module 62 is configured to provide the signal of the first level signal terminal VGH to the output terminal OUT in response to the signal of the second node N2.

As shown in FIG. 5, the control module 7 includes a control transistor Mc. The control transistor Mc has a control electrode electrically connected to a first control signal terminal C1, a first electrode electrically connected to an adjustment signal terminal D, and a second electrode electrically connected to the first node N1. In response to the signal of the first control signal terminal C1, the control transistor Mc provides the signal of the adjustment signal terminal D to the first node N1, so as to turn off the first output module 61, so that the residual charge of the first node N1 is prevented from turning on the first output module 61. If the residual charge of the first node N1 turns on the first output module 61, the signal of the second level signal terminal VGL may be transmitted to the output terminal OUT of the emission driving unit 10, causing the problem of the screen flicking when the display panel is starting up.

Figure 6:
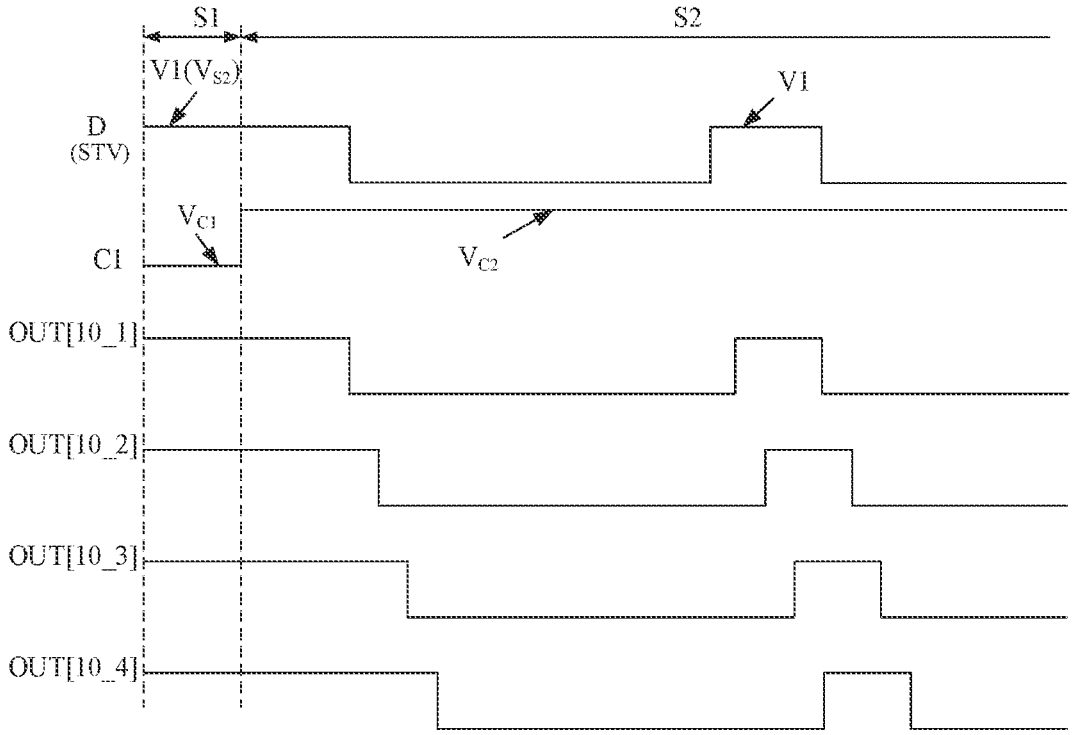
FIG. 6 is an operating timing diagram of an emission driving circuit according to an embodiment of the present disclosure.

Exemplarily, referring to FIG. 6 which is an operating timing diagram of the emission driving circuit 1 according to an embodiment of the present disclosure, an operating process of the emission driving circuit 1 includes a first stage S1 and a second stage S2.

In the first stage S1, the first control signal terminal C1 provides a signal $V_{C1}$ for turning on the control transistor Mc, and the adjustment signal terminal D provides a signal $V_{S2}$ for turning off the first output module 61. In the first stage S1, the control transistor Mc is turned on, and the signal $V_{S2}$ provided by the adjustment signal terminal D turns off the first output module 61, so that the low-level signal provided by the second level signal terminal VGL is prevented from being provided to the corresponding sub-pixel 4 through the first output module 61, the sub-pixel 4 cannot emit light in the first stage S1, thereby avoiding the screen flicking.

Exemplarily, as shown in FIG. 6, in the second stage S2, the first control signal terminal C1 provides a signal $V_{C2}$ for turning off the control transistor Mc, so as to prevent the signal of the adjustment terminal D from being inputted into the first node N1 in the second stage S2, so that the signal of the first node N1 is independent of the signal of the adjustment signal terminal D in the second stage S2. In the second stage S2, under the action of the input terminal IN, the first clock signal terminal XCK, the second clock signal terminal CK, the first level signal terminal VGH and the second level signal terminal VGL, the emission driving unit 10 can provide a pulse signal (including an active level and an inactive level) to the light-emitting control signal line Emit through the output terminal OUT. Referring to FIG. 3, during a period in which the emission driving unit 10 outputs an inactive level, the corresponding pixel driving circuit 41 can perform reset and charging operations. During a period in which the emission driving unit 10 outputs the active level signal, the corresponding pixel driving circuit 41 can perform a light-emitting operation. With such a configuration, the corresponding sub-pixel 4 can emit light with target brightness, so that the display panel can display images.

Exemplarily, the first stage S1 includes a starting up stage and/or a shutdown stage of the display panel 100, and the second stage S2 includes a normal display stage of the display panel 100.

In some embodiments of the present disclosure, a voltage difference between any two of the control electrode, the first electrode, or the second electrode of the control transistor Mc is smaller than or equal to a preset threshold, and/or, a duration in which the voltage difference between any two of the control electrode, the first electrode or the second electrode of the control transistor Mc is greater than the preset threshold the control electrode is smaller than or equal to a preset duration. Exemplarily, in the first stage S1 and the second stage S2, the voltage difference between any two of the control electrode, the first electrode or the second electrode of the control transistor Mc is smaller than or equal to the preset threshold. Additionally or alternatively, in the first stage S1 and the second stage S2, a duration in which the voltage difference between any two of the control electrode, the first electrode or the second electrode of the control transistor Mc is greater than the preset threshold the control electrode is smaller than or equal to a preset duration.

In some embodiments of the present disclosure, the first control signal terminal C1 is configured to receive a global control signal. In the second stage S2, in order not to affect the normal operation of the emission driving unit 10, the control transistor Mc is kept in the turned-off state. In the second stage S2, when a fixed voltage is continuously applied to the first control signal terminal C1 to keep the control transistor Mc in the turned-off state, the threshold voltage of the control transistor Mc may drift because the control transistor Mc is under a high bias voltage for a long time, so that unexpected turning-on or leakage of the control transistor Mc occurs, which affects the circuit operation stability of the emission driving unit 10.

In the embodiments of the present disclosure, the voltage difference between any two of the control electrode, the first electrode or the second electrode of the control transistor Mc is smaller than or equal to a preset threshold value, and/or, the duration in which the voltage difference between any two of the control electrode, the first electrode or the second electrode of the control transistor Mc is greater than the preset threshold is smaller than or equal to a preset duration. In this way, in addition to improving the flicker problem when starting up, the control transistor Mc can be prevented from being in a large bias state for a long time, thereby improving the stability of the control transistor Mc, and ensuring the stable operation of the display panel.

In the display panel provided by the embodiments of the present disclosure, the control module 7 is arranged in the emission driving unit 10, the control module 7 is used to adjust the operating state of the first output module 61. For example, when the display panel is started up and before the displaying of the first frame of image, or after the display panel is shutdown, the control module 7 can provide the signal of the adjustment signal terminal D to the first node N1 in response to the signal of the first control signal terminal C1, and the signal of the adjustment signal terminal D can turn off the first output module 61. As a result, the signal of the second level signal terminal VGL electrically connected to the first output module 61 is prevented from being outputted to the pixel driving circuit, and the light-emitting of the sub-pixel 4 is avoided. That is, the display panel provided by the embodiments of the present disclosure can effectively avoid the flicker problem of the display panel when starting up, and the display effect of the display panel is improved.

Moreover, in the embodiments of the present disclosure, by designing the control transistor Mc in the control module 7, the voltage difference between any two of the control electrode, the first electrode or the second electrode of the control transistor Mc is smaller than or equal to a preset threshold, and/or, the duration in which the voltage difference between any two of the control electrode, the first electrode or the second electrode of the control transistor Mc is greater than the preset threshold is smaller than or equal to a preset duration, so that the control transistor Mc is prevented from being in a large bias state for a long time, thereby ensuring the stability of the control transistor Mc.

Exemplarily, each of the multiple cascaded emission driving units 10 in the emission driving circuit 1 includes the control module 7, and the first control signal terminals C1 of the plurality of stages of emission driving units 10 are connected to a same first control signal line, and the adjustment signal terminals D of the plurality of stages of emission driving units 10 are connected to a same adjustment signal line. As a result, in the first stage S1, as shown in FIG. 6, each of the multiple cascaded emission driving units 10 outputs the signal that controls the corresponding sub-pixels 4 not to emit light, and thus a black state of a whole screen is realized in the first stage S1. In this way, the situation that the high-level emission control signal cannot be transmitted in the whole screen in the first stage S1 can be avoided, and the situation that some pixels in the display panel still emit light can be avoided.

Exemplarily, as shown in FIG. 5, the processing module 5 includes a first processing unit 51. The first processing unit 51 is electrically connected to the input terminal IN, the second clock signal terminal CK and the first node N1. The first processing unit 51 is configured to provide the signal of the input terminal IN to the first node N1 in response to the signal of the second clock signal terminal CK.

As shown in FIG. 5, the processing module 5 further includes a pull-down unit 53 and a pull-up unit 54. The pull-down unit 53 is electrically connected to the first level signal terminal VGH, a third node N3, the first clock signal terminal XCK and the first node N1. The pull-down unit 53 is configured to provide the signal of the first level signal terminal VGH to the first node N1 in response to the signal of the first clock signal terminal XCK and the signal of the third node N3. The pull-up unit 54 is electrically connected to the first node N1, the second node N2, the third node N3, the first level signal terminal VGH, the first clock signal terminal XCK and the second clock signal terminal CK. The pull-up unit 54 is configured to transmit a voltage signal to the second node N2 in response to the signals of the second clock signal terminal CK, the first node N1, the third node N3 and the first clock signal terminal XCK.

Exemplarily, as shown in FIG. 5, the first processing unit 51 includes a first transistor M1. A control electrode of the first transistor M1 is electrically connected to the second clock signal terminal CK, a first electrode of the first transistor M1 is electrically connected to the input terminal IN, and a second electrode of the first transistor M1 is electrically connected to the first node N1.

The pull-down unit 53 includes a fourth transistor M4 and a fifth transistor M5. A control electrode of the fourth transistor M4 is electrically connected to the third node N3, a first electrode of the fourth transistor M4 is electrically connected to the first level signal terminal VGH, and a second electrode of the fourth transistor M4 is electrically connected to a first electrode of the fifth transistor M5. A control electrode of the fifth transistor M5 is electrically connected to the first clock signal terminal XCK, and a second electrode of the fifth transistor M5 is electrically connected to the first node N1.

The pull-up unit 54 includes a sixth transistor M6, a seventh transistor M7, an eighth transistor M8, a ninth transistor M9 and a tenth transistor M10. A control electrode of the sixth transistor M6 is electrically connected to the second clock signal terminal CK, a first electrode of the sixth transistor M6 is electrically connected to the second level signal terminal VGL, and a second electrode of the sixth transistor M6 is electrically connected to the third node N3. A control electrode of the seventh transistor M7 is electrically connected to the first node N1, a first electrode of the seventh transistor M7 is electrically connected to the second clock signal terminal CK, and a second electrode of the seventh transistor M7 is electrically connected to the third node N3. A control electrode of the eighth transistor M8 is electrically connected to the third node N3, a first electrode of the eighth transistor M8 is electrically connected to the first clock signal terminal XCK. A control electrode of the ninth transistor M9 is electrically connected to the first clock signal terminal XCK, a first electrode of the ninth transistor M9 is electrically connected to the second electrode (that is, the fourth node N4) of the eighth transistor M8, and a second electrode of the ninth transistor M9 is electrically connected to the second node N2. A control electrode of the tenth transistor M10 is electrically connected to the first node N1, a first electrode of the tenth transistor M10 is electrically connected to the first level signal terminal VGH, and a second electrode of the tenth transistor M10 is electrically connected to the second node N2.

As shown in FIG. 5, the first output module 61 includes an eleventh transistor M11. A control electrode of the eleventh transistor M11 is electrically connected to the first node N1, a first electrode of the eleventh transistor M11 is electrically connected to the second level signal terminal VGL, and a second electrode of the eleventh transistor M11 is electrically connected to the output terminal OUT. The second output module 62 includes a twelfth transistor M12. A control electrode of the twelfth transistor M12 is electrically connected to the second node N2, a first electrode of the twelfth transistor M12 is electrically connected to the first level signal terminal VGH, and a second electrode of the twelfth transistor M12 is electrically connected to the output terminal OUT.

As shown in FIG. 5, the emission driving unit 10 further includes a first capacitor Cst1, a second capacitor Cst2 and a third capacitor Cst3. A first plate of the first capacitor Cst1 is electrically connected to the first node N1, and a second plate of the first capacitor Cst1 is electrically connected to the first clock signal terminal XCK. A first plate of the second capacitor Cst2 is electrically connected to the third node N3, and a second plate of the second capacitor Cst2 is electrically connected to the second electrode of the eighth transistor M8. A first plate of the third capacitor Cst3 is electrically connected to the first level signal terminal VGH, and a second plate of the third capacitor Cst3 is electrically connected to the second node N2.

Figure 7:
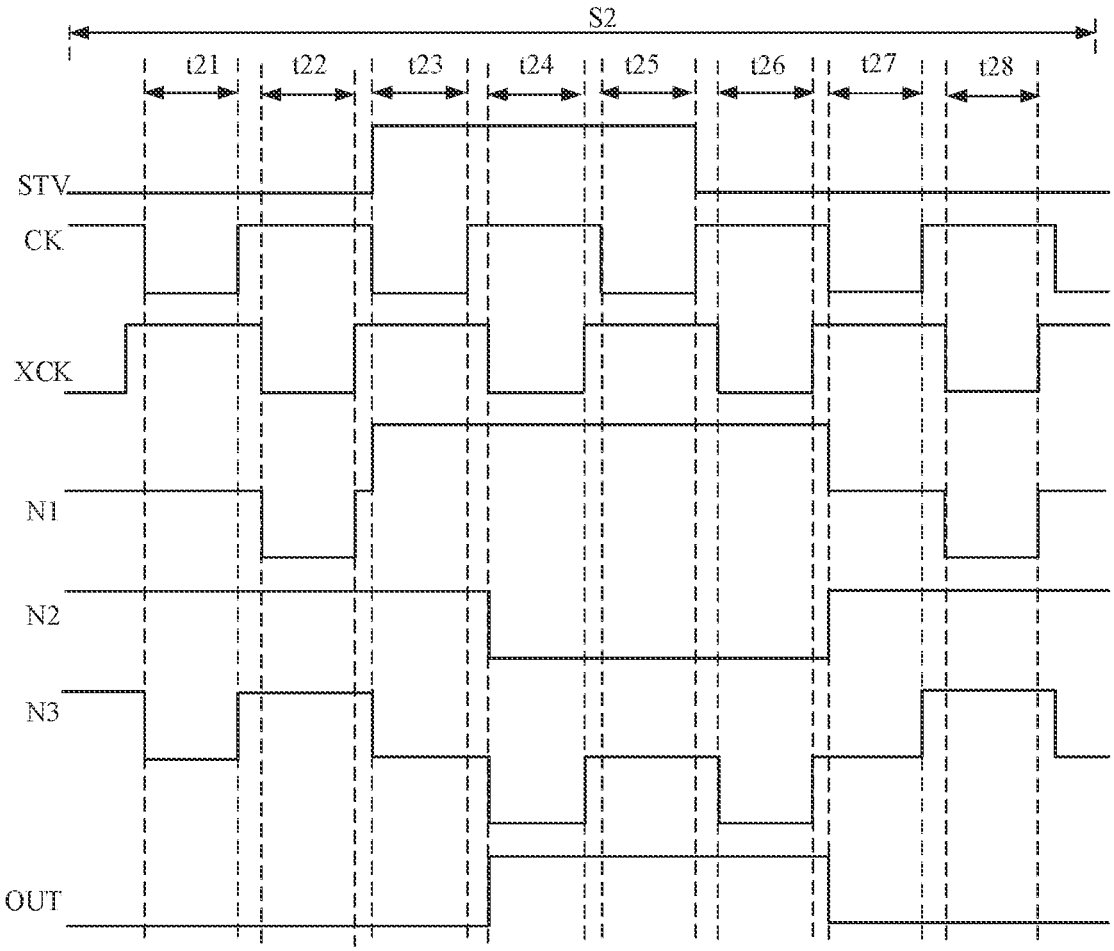
FIG. 7 is an operating timing diagram of the emission driving unit shown in FIG. 5 in a second stage.

In the second stage S2, the plurality of stages of emission driving units 10 in the emission driving circuit 1 sequentially output the active level signal under the cooperation of the signals connected thereto. FIG. 7 is an operating timing diagram of the emission driving unit 10 shown in FIG. 5 in the second stage S2. Taking the first-stage emission driving unit electrically connected to the start signal line STV shown in FIG. 5 as an example, in conjunction with FIG. 5 and FIG. 7, an operating process of the emission driving unit 10 in the second stage S2 is described. In the second stage S2, the operating process of the emission driving unit 10 includes a first sub-period t21, a second sub-period t22, a third sub-period t23, a fourth sub-period t24, a fifth sub-period t25, a sixth sub-period t26, a seventh sub-period t27, and an eighth sub-period 28.

In the first sub-period t21, the second clock signal terminal CK provides a low-level signal, the first clock signal terminal XCK provides a high-level signal, and the start signal line STV provides a low-level signal. The first transistor M1 and the sixth transistor M6 are turned on, the low-level signal provided by the start signal line STV is inputted to the first node N1 through the turned-on first transistor M1 making the potential of first node N1 at a low-level state, and the seventh transistor M7, the tenth transistor M10 and the eleventh transistor M11 are turned on. The high-level signal provided by the first level signal terminal VGH is inputted to the second node N2 high through the turned-on tenth transistor M10 making the potential of the second node N2 at a high-level state, and the twelfth transistor M12 is turned off. The low-level signal provided by the second level signal terminal VGL is inputted to the output terminal OUT through the turned-on eleventh transistor M11 making the potential of the output terminal OUT at a low-level state. The low-level signal provided by the second clock signal terminal CK is inputted to the third node N3 through the turned-on seventh transistor M7 making the potential of the third node N3 at a low-level state. The low-level signal provided by the second level signal terminal VGL is inputted to the third node N3 through the turned-on sixth transistor M6 making the potential of the third node N3 at a low-level state. The fourth transistor M4 and the eighth transistor M8 are turned on, and the high-level signal provided by the first clock signal terminal XCK is inputted to the fourth node N4 through the turned-on eighth transistor M8.

In the second sub-period t22, the second clock signal terminal CK provides a high-level signal, the first clock signal terminal XCK provides a low-level signal, and the start signal line STV provides a low-level signal. The first transistor M1 and the sixth transistor M6 are turned off, and the first node N1 maintains the low-level as in the first sub-period t21. The seventh transistor M7, the tenth transistor M10 and the eleventh transistor M11 are turned on, and the high-level signal of the second clock signal terminal CK is inputted to the third node N3 turned-on through the seventh transistor M7 making the third node N3 at a high-level state. The fourth transistor M4 and the eighth transistor M8 are turned off. The high-level signal of the first level signal terminal VGH is inputted to the second node N2 through the turned-on tenth transistor M10 making the second node N2 at a high-level state. When the first clock signal terminal XCK jumps from a high-level to a low-level, the potential of the first node N1 changes from a low-level to a third level smaller than the low-level though the coupling of the first capacitor Cst1 . The eleventh transistor M11 can be stably kept in the turned-on state, and provides the low-level signal of the second level signal terminal VGL to the output terminal OUT.

In the third sub-period t23, the second clock signal terminal CK provides a low-level signal, the first clock signal terminal XCK provides a high-level signal, and the start signal line STV provides a high-level signal. The first transistor M1 and the sixth transistor M6 are turned on, the high-level signal provided by the start signal line STV is inputted to the first node N1 through the turned-on first transistor M1 making the first node N1 at a high-level state, and the seventh transistor M7, the tenth transistor M10 and the eleven transistors M11 are turned off. The low-level signal provided by the second level signal terminal VGL is inputted to the third node N3 through the turned-on sixth transistor M6 making the third node N3 at a low-level state, and the fourth transistor M4 and the eighth transistor M8 are turned on. The high-level signal provided by the first clock signal terminal XCK is inputted to the fourth node N4 through the turned-on eighth transistor M8 making the fourth node N4 at a high-level state. The ninth transistor M9 is turned off under the action of the first clock signal terminal XCK, the second node N2 maintains the high-level of the second sub-period t2, the twelfth transistor M12 is turned off, and the output terminal OUT maintains the low-level of the second sub-period t22.

In the fourth sub-period t24, the second clock signal terminal CK provides a high-level signal, the first clock signal terminal XCK provides a low-level signal, and the start signal line STV provides a high-level signal. The first transistor M1 and the sixth transistor M6 are turned off. The first node N1 maintains the high-level of the third sub-period t23. The seventh transistor M7, the tenth transistor M10 and the eleventh transistor M11 are turned off. The third node N3 maintains the low-level of the third sub-period t23. The fourth transistor M4 and the eighth transistor M8 are turned on. When the first clock signal terminal XCK jumps from a high-level to a low-level, the low-level signal provided by the first clock signal terminal XCK is inputted to the fourth node N4 through the turned-on eighth transistor M8. The third node N3 is pulled lower due to the coupling of the second capacitor Cst2, so that the eighth transistor M8 is stably kept in a turned-on state. Under the action of the low-level provided by the first clock signal terminal XCK, the fifth transistor M5 and the ninth transistor M9 are turned on, and the high-level signal provided by the first level signal terminal VGH is inputted to the first node N1 through the turned-on fourth transistor M4 and the turned-on fifth transistor M5 making the first node N1 at a high-level state. The low potential of the fourth node N4 is inputted to the second node N2 through the turned-on ninth transistor M9 making the second node N2 at a low-level state, and the twelfth transistor M12 is turned on. The first level signal terminal VGH makes the output terminal OUT at a high-level state through the turned-on twelfth transistor M12.

In the fifth sub-period t25, the second clock signal terminal CK provides a low-level signal, the first clock signal terminal XCK provides a high-level signal, and the start signal line STV provides a high-level signal. The first transistor M1 and the sixth transistor M6 are turned on. The high-level signal provided by the start signal line STV is inputted to the first node N1 through the first transistor M1 making the first node N1 at a high-level state. The seventh transistor M7, the tenth transistor M10 and the eleventh transistor M11 are turned off. The low-level signal provided by the second level signal terminal VGL is inputted to the third node N3 through the turned-on sixth transistor M6 making the third node N3 at a low-level state. The fourth transistor M4 and the eighth transistor M8 are turned on. The high-level signal provided by the first clock signal terminal XCK is inputted to the fourth node N4 through the turned-on eighth transistor M8 making the fourth node N4 at a high-level state. The ninth transistor M9 is turned off. The second node N2 maintains a low-level state as in the fourth sub-period t4, and the twelfth transistor M12 is turned on. The first level signal terminal VGH makes the output terminal OUT at a high-level state through the twelfth transistor M12 turned on.

In the sixth sub-period t26, the second clock signal terminal CK provides a high-level signal, the first clock signal terminal XCK provides a low-level signal, and the start signal line STV provides a low-level signal. The first transistor M1 and the sixth transistor M6 are turned off. The first node N1 maintains the high-level as in the fifth sub-period t25. The seventh transistor M7, the tenth transistor M10 and the eleventh transistor M11 are turned off. The third node N3 maintains the low-level as in the fifth sub-period t25. The fourth transistor M4 and the eighth transistor M8 are turned on. The first level signal terminal VGH makes the first node N1 at a high-level state through the fourth transistor M4 and the fifth transistor M5 that are turned on. When the first clock signal terminal XCK jumps from a high-level to a low-level, the low-level is inputted to the fourth node N4 through the turned-on eighth transistor M8 making the fourth node N4 at a low-level state. Due to the coupling of the third capacitor Cst3, the potential of the third node N3 is further pulled down, and the eighth transistor M8 is stably maintained in a turned-on state. At the same time, the ninth transistor M9 is turned on, the low-level signal of the fourth node N4 is inputted to the second node N2 through the turned-on ninth transistor M9 making the fourth node N4 at a low-level state, the twelfth transistor M12 is turned on, and the high-level signal provided by the first level signal terminal VGH is inputted to the output terminal OUT through the turned-on twelfth transistor M12 making the output terminal OUT at a high-level state.

In the seventh sub-period t27, the second clock signal terminal CK provides a low-level signal, the first clock signal terminal XCK provides a high-level signal, and the start signal line STV provides a low-level signal. The first transistor M1 and the sixth transistor M6 are turned on. The low-level signal provided by the start signal line STV is inputted to the first node N1 through the first transistor M1 making the first node N1 at a low-level state. The seventh transistor M7, the tenth transistor M10 and the eleventh transistor M11 are turned on. The low-level signal provided by the second level signal terminal VGL is inputted to the third node N3 through the turned-on sixth transistor M6 making the third node N3 at a low-level state. The fourth transistor M4 and the eighth transistor M8 are turned on, and the high-level signal provided by the first clock signal terminal XCK is inputted to the fourth node N4 through the turned-on eighth transistor M8 making the fourth node N4 at a high-level state. The ninth transistor M9 is turned off. The low-level signal of the second level signal terminal VGL is provided to the output terminal OUT through the turned-on eleventh transistor M11. The high-level signal provided by the first level signal terminal VGH is inputted to the second node N2 through the turned-on twelfth transistor M12 making the second node N2 at a high-level state, and the twelfth transistor M12 is turned off.

In the eighth sub-period t28, the second clock signal terminal CK provides a high-level signal, the first clock signal terminal XCK provides a low-level signal, and the start signal line STV provides a low-level signal. The first transistor M1 and the sixth transistor M6 are turned off. The first node N1 maintains the low-level as in the seventh sub-period t27. The seventh transistor M7, the tenth transistor M10 and the eleventh transistor M11 are turned on. The second clock signal terminal CK makes the third node N3 at a high-level state through the turned-on seventh transistor M7, and the fourth transistor M4 and the eighth transistor M8 are turned off. The first level signal terminal VGH makes the second node N2 at a high-level state through the turned-on tenth transistor M10. When the first clock signal terminal XCK jumps from a high-level to a low-level, the potential of the first node N1 changes from a low-level to a third level smaller than the low-level due to the coupling of the first capacitor Cst1 . The eleventh transistor M11 is stably kept in the turned-on state, and provides the low-level signal of the second level signal terminal VGL to the output terminal OUT.

Exemplarily, as shown in FIG. 6, the adjustment signal terminal D is configured to transmit a pulse signal including a first level V1, where the first level V1 is a signal capable of controlling the first output module 61 to be turned off. For example, when the first output module 61 includes a P-type transistor, the first level V1 may be equal to the level provided by the first level signal terminal VGH.

As shown in FIG. 6, in some embodiments of the present disclosure, the adjustment signal terminal D may transmit the first level V1 constantly in the first stage S1, and transmit the pulse signal including the first level V1 in the second stage S2. In this way, on the one hand, the adjustment signal terminal D can stably provide the first level V1 for turning off the first output module 61 to the first node N1 in the first stage S1, so as to ensure that the emission driving unit 10 can output the signal for controlling the sub-pixel 4 not to emit light. On the other hand, in the embodiments of the present disclosure, by setting the signal transmitted by the adjustment signal terminal D as a pulse signal in the second stage S2, the first electrode of the control transistor Mc electrically connected to the adjustment signal terminal D can be prevented from being at the first level V1 for a long time, while ensuring that the first output module 61 is turned off in the first stage S1.

As mentioned above, in the second stage S2, when the output terminal OUT of the emission driving unit 10 outputs an active level that causes the sub-pixel 4 to emit light, the first node N1 of the emission driving unit 10 is at an active level that causes the first output module 61 to be turned on. If the first electrode of the control transistor Mc is continuously at an inactive level that turns off the first output module 61, the first electrode and the second electrode of the control transistor Mc will be continuously subjected to a large voltage difference since the second electrode of the control transistor Mc is electrically connected to the first node N1. In some embodiments of the present disclosure, by setting the signal transmitted by the adjustment signal terminal D as a pulse signal, a duration in which the adjustment signal terminal D transmits the first level V1 can be shortened, thereby helping to shorten the duration in which a large voltage difference occurs between the first electrode and the second electrode of the control transistor Mc, and improving the stability of the control transistor Mc.

Figure 8:
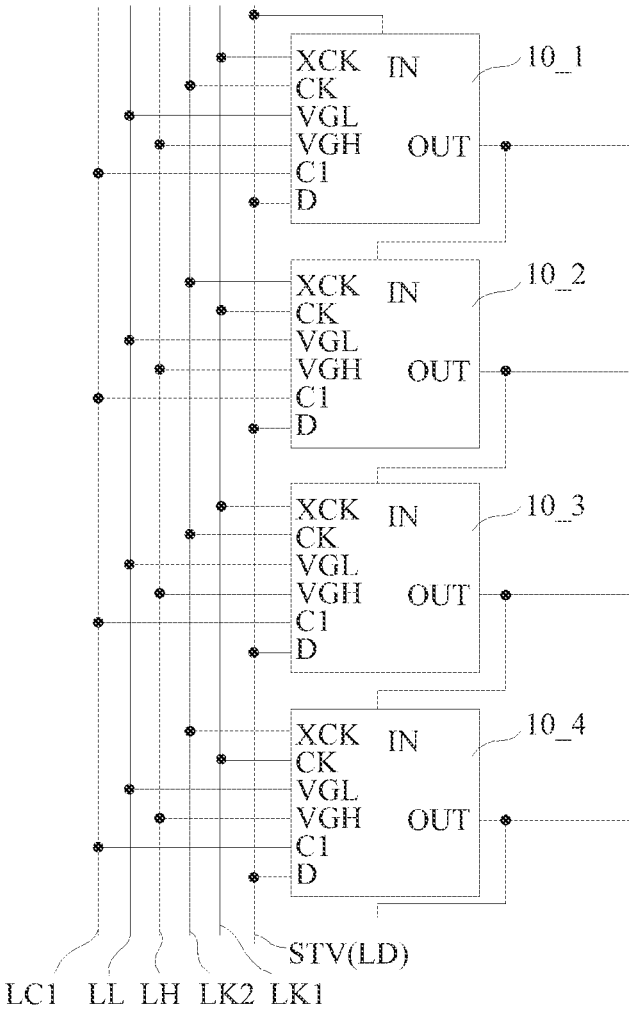
FIG. 8 is a schematic diagram of an emission driving circuit according to another embodiment of the present disclosure.

Exemplarily, referring to FIG. 5, FIG. 6 and FIG. 8, FIG. 8 is a schematic diagram of an emission driving circuit according to another embodiment of the present disclosure, when the adjustment signal terminal D receives a pulse signal, the adjustment signal terminals D of the plurality of stages of emission driving units 10 are all electrically connected to the start signal line STV. That is, the adjustment signal terminals D of the plurality of stages of emission driving units 10 and the input terminal IN of the first-stage emission driving unit 10 receive the same signal. In some embodiments, as shown in FIG. 6, in the first stage S1, the start signal line STV constantly transmits the first level V1 that causes the first output module 61 to be turned off, and in the second stage S2, the start signal line STV periodically outputs a pulse signal. In some embodiments of the present disclosure, the first electrode of the control transistor Mc is electrically connected to the start signal line STV, while shortening the duration in which a large voltage difference occurs between the first electrode and the second electrode of the control transistor Mc and improving the stability of the transistor Mc, it can also avoid introducing too many traces in the display panel 100, can reduce the area of the non-display region occupied by the emission driving circuit 1 and the signal lines, thereby simplifying the structure of the display panel 100 and increasing the screen-to-body ratio of the display panel 100.

Figure 9:
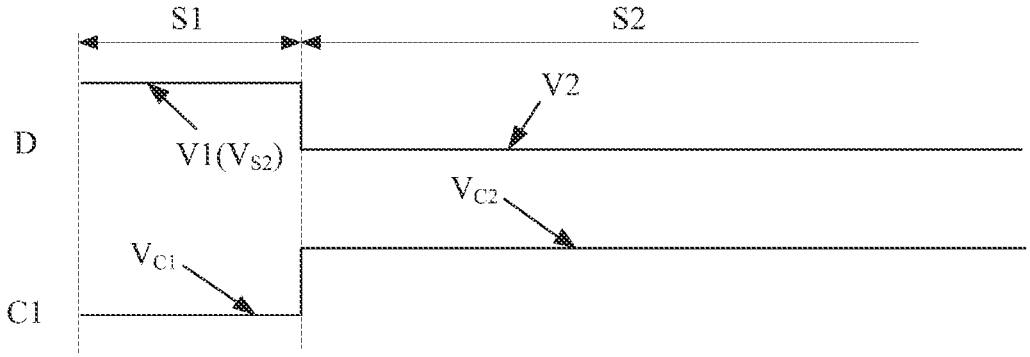
FIG. 9 is an operating timing diagram of an emission driving circuit according to another embodiment of the present disclosure.

In some embodiments, as shown in FIG. 9 which is an operating timing diagram of an emission driving circuit according to another embodiment of the present disclosure, the adjustment signal terminal D transmits the first level V1 constantly in the first stage S1, and transmits the second level V2 constantly in the second stage S2. The first level V1 is an inactive level for controlling the first output module 61 to be turned off, and the second level V2 is an active level for controlling the first output module 61 to be turned on. For example, when the first output module 61 includes a P-type transistor, the first level V1 may be equal to the level provided by the first level signal terminal VGH, and the second level V2 may be equal to the level provided by the second level signal terminal VGL. With such a configuration, the voltage difference between the first electrode and the second electrode of the control transistor Mc can be reduced in the second stage S2, thereby improving the stability of the control transistor Mc.

Exemplarily, as shown in FIG. 6 and FIG. 9, the potential of the active voltage transmitted by the first control signal terminal C1 is $V_{C1}$, and the potential of the inactive voltage transmitted by the first control signal terminal C1 is $V_{C2}$; the potential of the inactive voltage transmitted by the adjustment signal terminal D is $V_{S2}$; and the inactive voltage transmitted by the adjustment signal terminal D is configured to turn off the first output module 61. Exemplarily, $V_{S2}$ may be equal to the first level V1 for turning off the first output module 61. In some embodiments of the present disclosure, $|V_{C2}| \geq |V_{S2}|$. With such a configuration, the risk that the control transistor Mc is turned on by mistake in the second stage S2 can be reduced.

Figure 10:
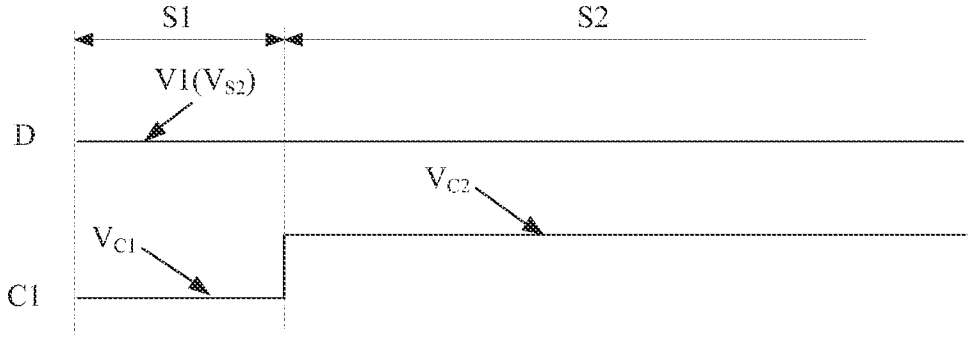
FIG. 10 is an operating timing diagram of an emission driving circuit according to another embodiment of the present disclosure.

Exemplarily, in some embodiments of the present disclosure, the adjustment signal terminal D may transmit a constant signal. As shown in FIG. 10 which is an operating timing diagram of an emission driving circuit according to another embodiment of the present disclosure, in the first stage S1 and the second stage S2, the adjustment signal terminals D each transmit the first level V1. The first level V1 is configured to turn off the first output module 61. For example, when the first output module 61 includes a P-type transistor, the first level V1 may be equal to the level provided by the first level signal terminal VGH.

Figure 11:
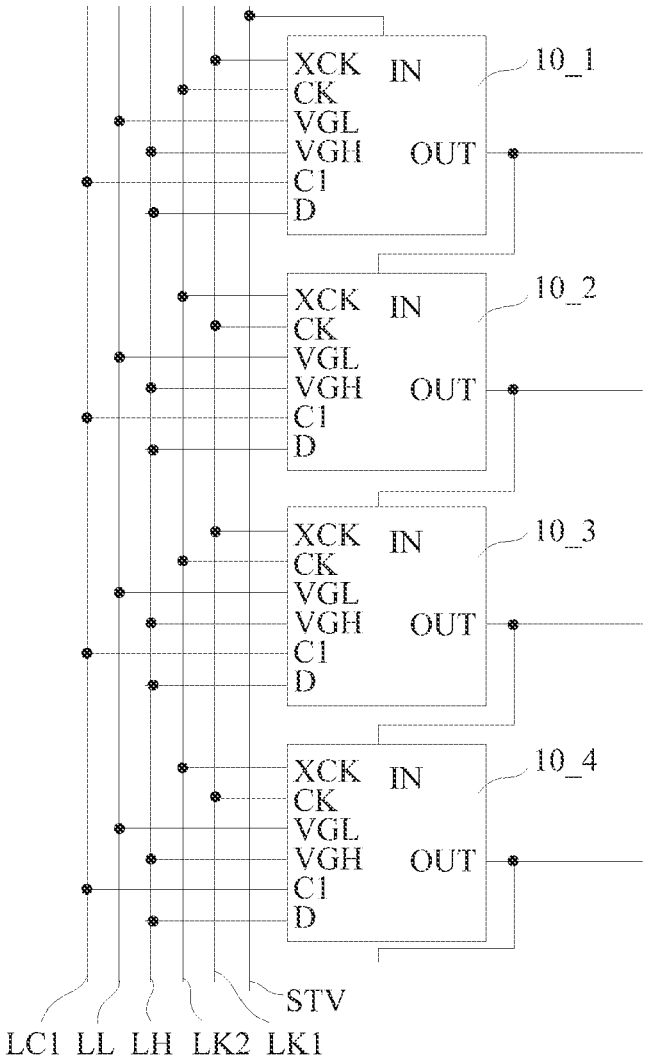
FIG. 11 is a schematic diagram of an emission driving circuit according to another embodiment of the present disclosure.

In some embodiments, as shown in FIG. 11 which is a schematic diagram of an emission driving circuit according to another embodiment of the present disclosure, the first level signal line LH may be electrically connected to the first level signal terminal VGH and the adjustment signal terminal D of each of the multiple emission driving units 10. That is, the adjustment signal terminals D of the plurality of stages of emission driving units 10 and the first level signal terminals VGH of the plurality of stages of emission driving units 10 receive the same signal. With such a configuration, on the one hand, the power consumption of the display panel can be reduced. On the other hand, the number of signal lines the display panel 100 is reduced, so that the area of the non-display region occupied by the emission driving circuit 1 and the signal lines can be reduced, thereby simplifying the structure of the display panel 100 and increasing the screen-to-body ratio of the display panel 100.

Exemplarily, after the display panel enters the second stage S2, the display panel enters a frame image display stage and performs displaying frame by frame. Taking the refresh frequency of the frame image as F as an example, in the display time of the frame image with the frequency of F, the output signal of the emission driving unit 10 includes at least N pulses, N*F≥240 Hz, where N is an integer greater than or equal to 1. That is, the frequency of the signal outputted by the emission driving unit 10 may be greater than or equal to 240 Hz. With such a configuration, the signal outputted by the emission driving unit 10 can be switched between the active level and the inactive level at a relatively high frequency. That is, the output terminal OUT of the emission driving unit 10 can be prevented from continuously outputting the active level for a long time. When the emission driving unit 10 outputs the active level, the first node N1 of the emission driving unit 10 is in an active level state that enables the first output module 31 to be turned on. When the adjustment signal terminal D connected to the first electrode of the control transistor Mc constantly transmits an inactive level that causes the first output module 31 to be turned off, such a setting manner can shorten the duration in which the first electrode and the second electrode of the control transistor Mc are subjected to a large voltage difference, thereby improving the stability of the control transistor Mc.

Exemplarily, in some embodiments of the present disclosure, the frequency of the output signal of the emission driving unit 10 may be greater than or equal to 1440 Hz. In some embodiments of the present disclosure, the frequency of the output signal of the emission driving unit 10 may be greater than or equal to 1920 Hz.

Exemplarily, in the display time of a frame image with a frequency of F, in some embodiments of the present disclosure, the signal transmitted by the start signal line STV may include at least N pulses, N*F≥240, so that the emission driving unit 10 outputs the N pulses within a display cycle of one frame of image, thereby shortening the duration in which the control transistor Mc is subjected to a relatively large voltage difference. Exemplarily, in some embodiments of the present disclosure, the refresh frequency F of the frame image may be 120 Hz, and N≥2. In some embodiments of the present disclosure, the refresh frequency F of the frame image is 60 Hz, and N≥4.

Exemplarily, in some embodiments of the present disclosure, the frequency of the signal transmitted by the start signal line STV may be set to be greater than or equal to 1440 Hz. Further, in some embodiments of the present disclosure, the frequency of the signal transmitted by the start signal line STV may be set to be greater than or equal to 1920 Hz.

In some embodiments of the present disclosure, a duty ratio of an active level of the output signal of the emission driving unit 10 may be set to be smaller than or equal to the first preset value. Under the action of the active level, the corresponding sub-pixel can emit light. With such a configuration, a constant duration in which the emission driving unit 10 constantly outputs the active level is smaller than or equal to a preset duration, so that the duration in which the first electrode and second electrode of the control transistor Mc are subjected to a large voltage difference can be shortened, thereby improving the stability of the control transistor Mc.

Exemplarily, the first preset value is smaller than or equal to 99%.

In some embodiments, the emission driving unit 10 further includes a bootstrap module. The bootstrap module has a first electrode connected to the first node N1, and a second electrode electrically connected to the first clock signal terminal XCK. In some embodiments of the present disclosure, a duty ratio of the active level transmitted by the first clock signal terminal XCK is smaller than or equal to a second preset value.

Exemplarily, as shown in FIG. 5, the bootstrap module 8 includes a first capacitor Cst1.

Figure 12:
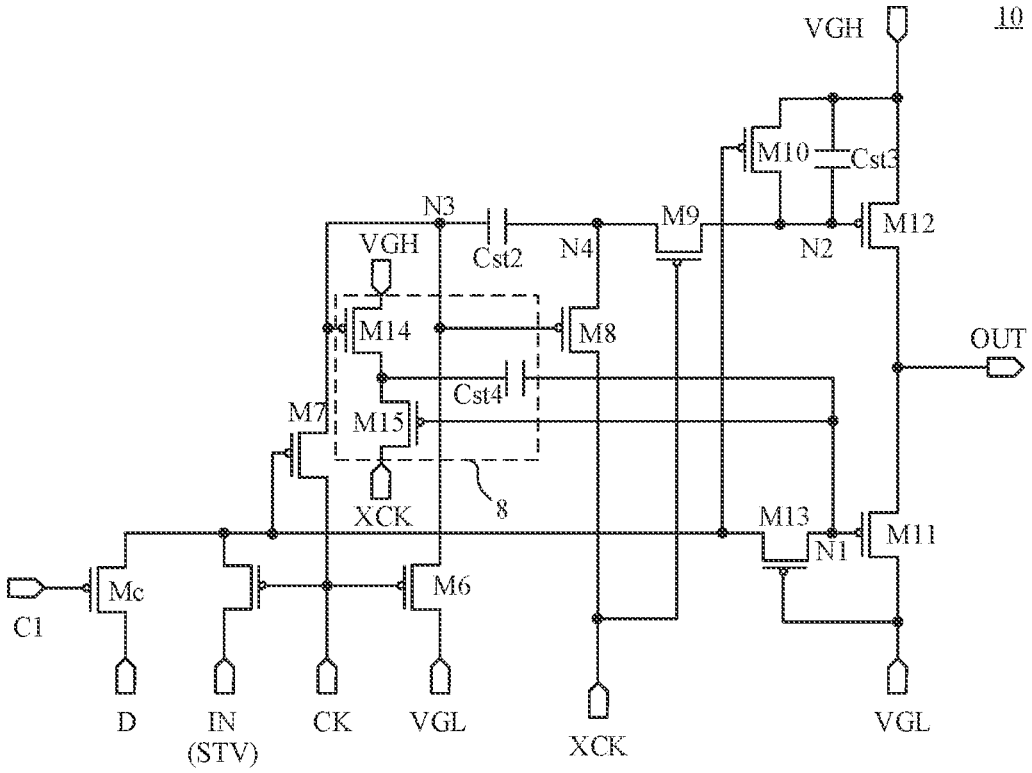
FIG. 12 is a schematic diagram of an emission driving circuit according to another embodiment of the present disclosure.

In some embodiments, as shown in FIG. 12 which is a schematic circuit diagram of an emission driving unit according to another embodiment of the present disclosure, the bootstrap module 8 includes: a fourth capacitor Cst4, a fourteenth transistor M14 and a fifteenth transistor M15. A first plate of the fourth capacitor Cst4 is electrically connected to the first node N1. A second plate of the fourth capacitor Cst4 is electrically connected to the first clock signal terminal XCK through the fifteenth transistor M15, and is electrically connected to the first level signal terminal VGH through the fourteenth transistor M14. A control electrode of the fourteenth transistor M14 is electrically connected to the third node N3. A control electrode of the fifteenth transistor M15 is electrically connected to the first node N1. In FIG. 12, the same elements as those in FIG. 5 are denoted by the same reference numerals, and the connection relationship and the operating process thereof can be referred to the above description about FIG. 5, which will not be elaborated here.

As mentioned above, when the emission driving unit 10 is operating, in the first sub-period t21 shown in FIG. 7, the first node N1 is at a low-level that is equal to the second level provided by the second level signal terminal VGL. After entering the second sub-period t22, when the signal provided by the first clock signal terminal XCK is changed from a high-level to a low-level, the potential of the first node N1 may be pulled to a third level lower than the second level provided by the second level signal terminal VGL under the bootstrap action of the bootstrap module 8. Until the signal provided by the first clock signal terminal XCK is changed from a low-level to a high-level, the potential of the first node N1 will be pulled up from the third level to the second level. When the first node N1 is at the third level, if the voltage of the first electrode of the control transistor Mc is large, the control transistor Mc will be subjected to a large voltage difference. In some embodiments of the present disclosure, by shortening the constant duration in which the first clock signal terminal XCK is kept at a low-level, the constant duration in which the potential of the first node N1 is kept at the third level can be shortened, so that the constant duration in which the second electrode of the control transistor Mc electrically connected to the first node N1 is kept at the third level is shortened, thereby improving the stability of the control transistor Mc.

In some embodiments, the second preset value is smaller than or equal to 40%.

Figure 13:
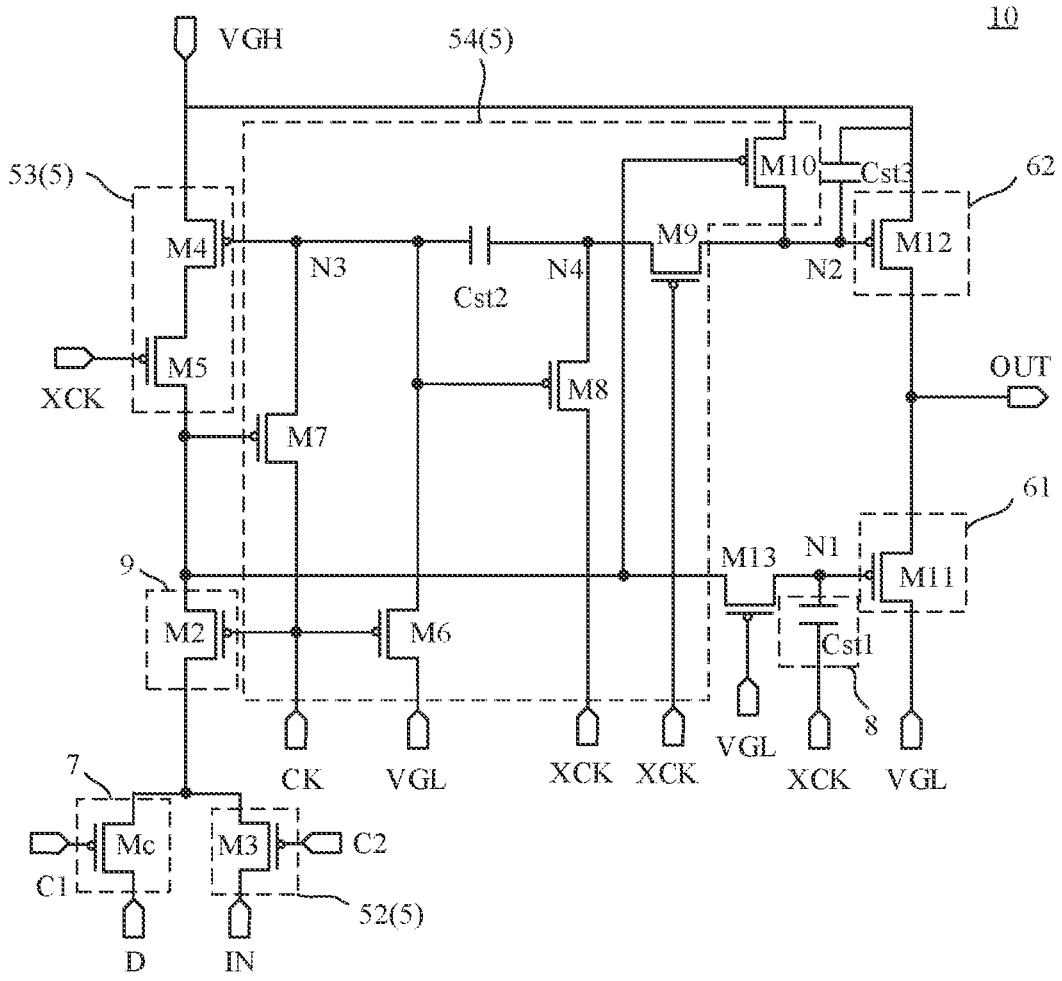
FIG. 13 is a schematic circuit diagram of an emission driving unit according to another embodiment of the present disclosure.

FIG. 13 is a schematic circuit diagram of an emission driving unit according to another embodiment of the present disclosure. In FIG. 13, the same elements as those in FIG. 5 are denoted by the same reference numerals, and the connection relationship and the operating process thereof can be referred to the above description about FIG. 5, which will not be elaborated here. In some embodiments, as shown in FIG. 12 and FIG. 13, the emission driving unit 10 further includes a thirteenth transistor M13. The thirteenth transistor M13 has a control electrode electrically connected to the second level signal terminal VGL, a first electrode electrically connected to the second electrode of the control transistor Mc, and a second electrode electrically connected to the first node N1. During the operation of the emission driving unit 10, when the first node N1 is at a third level lower than the low-level, the thirteenth transistor M13 can raise the potential of the second electrode of the control transistor Mc, which is beneficial to reducing the voltage difference between the first electrode and the second electrode of the control transistor Mc and reducing the voltage difference between the control electrode and the second electrode of the control transistor Mc, thereby improving the stability of the control transistor Mc.

In some embodiments, as shown in FIG. 13, the emission driving unit 10 further includes a protection module 9. The protection module 9 has a first terminal electrically connected to the control transistor Mc, and a second terminal electrically connected to the first node N1. The protection module 9 is configured to electrically connect the first node N1 and the control transistor Mc in response to the signal of the second clock signal terminal CK. When the potential of the first node N1 is pulled to a third level lower than the second level under the action of the bootstrap module 8, the protection module 9 can raise the potential of the second electrode of the control transistor Mc, so that it is beneficial to reducing the voltage difference between the first electrode and the second electrode of the control transistor Mc, and reducing the voltage difference between the control electrode and the second electrode of the control transistor, thereby improving the reliability of the control transistor Mc.

Exemplarily, as shown in FIG. 13, the protection module 9 includes a second transistor M2. The second transistor M2 has a control electrode electrically connected to the second clock signal terminal CK, a first electrode electrically connected to the control transistor Mc, and a second electrode electrically connected to the first Node N1.

Figure 14:
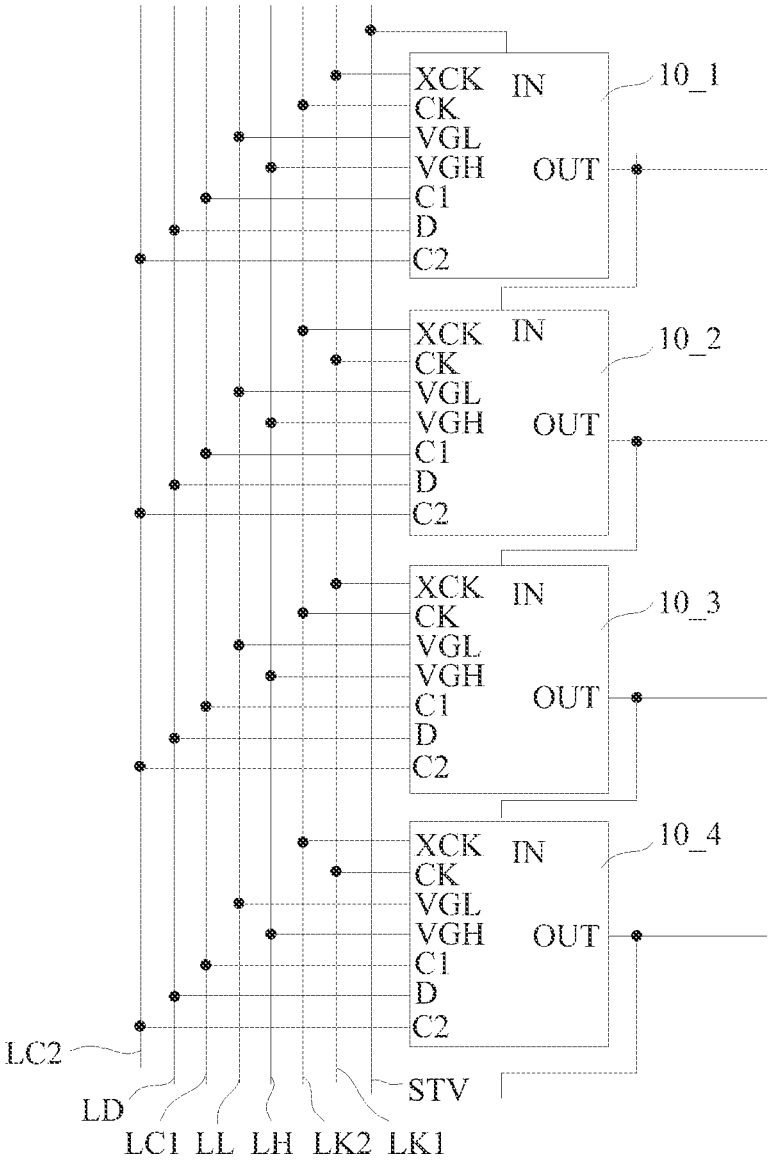
FIG. 14 is a schematic diagram of an emission driving circuit according to another embodiment of the present disclosure.

Exemplarily, as shown in FIG. 13, the processing module 5 further includes a second processing unit 52. The second processing unit 52 has a first terminal electrically connected to the input terminal IN, and a second terminal electrically connected to the first terminal of the protection module 9. The second processing unit 52 provides the signal of the input terminal IN to the protection module 9 in response to the signal of the second control signal terminal C2. In some embodiments of the present disclosure, the second processing unit 52 and the control module 7 operate in a time-divisional manner. In the first stage S1, the first control signal terminal C1 controls the control module 7 to be turned on, and the second control signal terminal C2 controls the second processing unit 52 to be turned off, so that the signal provided by the adjustment signal terminal D is supplied to the protection module 9. In the second stage S2, the first control signal terminal C1 controls the control module 7 to be turned off, and the second control signal terminal C2 controls the second processing unit 52 to be turned on, so that the signal of the input terminal IN is supplied to the protection module 9. As shown in FIG. 14, the second processing unit 52 includes a third transistor M3. The third transistor M3 has a control electrode electrically connected to the second control signal terminal C2, a first electrode electrically connected to the input terminal IN, and a second electrode electrically connected to the protection module 9.

Exemplarily, as shown in FIG. 14 which is a schematic diagram of an emission driving circuit according to another embodiment of the present disclosure, the display panel further includes a first control signal line LC1, a second control signal line LC2 and an adjustment signal line LD. The first control terminal C1 of each emission driving unit 10 is electrically connected to the first control signal line LC1, the second control terminal C2 of each emission driving unit 10 is electrically connected to the second control signal line LC2, and the first electrode of the control transistor Mc is electrically connected to the adjustment signal line LD.

Figure 15:
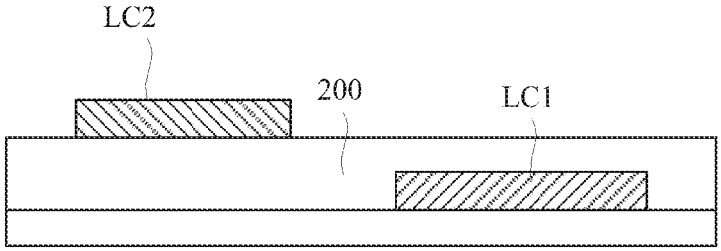
FIG. 15 is a cross-sectional view of a first control signal line and a second control signal line according to an embodiment of the present disclosure.

Exemplarily, as shown in FIG. 15 which is a cross-sectional view of the first control signal line LC1 and the second control signal line LC2 according to an embodiment of the present disclosure, the first control signal line LC1 and the second control signal line LC2 are provided in different layers, and along a direction perpendicular to a plane of the display panel, the first control signal lines LC1 does not overlap with the second control signal lines LC2. As shown in FIG. 15, along the direction perpendicular to the plane of the display panel, an insulating layer 200 is provided between the first control signal line LC1 and the second control signal line LC2. Such a configuration is beneficial to reducing the coupling between the first control signal line LC1 and the second control signal line LC2.

Figure 16:
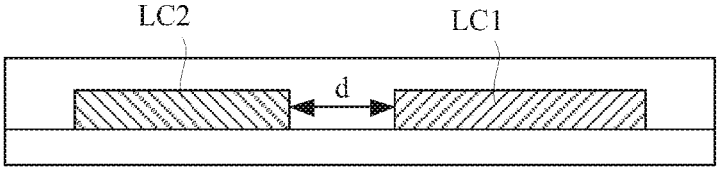
FIG. 16 is a cross-sectional view of a first control signal line and a second control signal line according to another embodiment of the present disclosure.

In some embodiments, as shown in FIG. 16 which is a cross-sectional view of the first control signal line LC1 and the second control signal line LC2 according to another embodiment of the present disclosure, the first control signal line LC1 and the second control signal line LC2 may be provided in the same layer, and a distance d between the first control signal line LC1 and the second control signal line LC2 is set to be greater than 3 μm, so as to reduce the coupling between the first control signal line LC1 and the second control signal line LC2.

Figure 17:
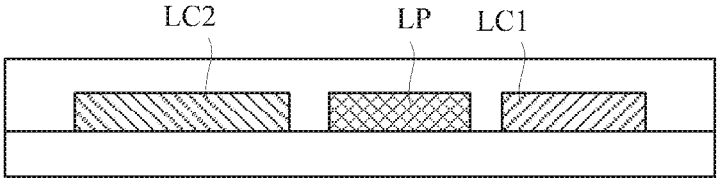
FIG. 17 is a cross-sectional view of a first control signal line and a second control signal line according to another embodiment of the present disclosure.

In some embodiments, as shown in FIG. 17 which is a cross-sectional view of the first control signal line LC1 and the second control signal line LC2 according to another embodiment of the present disclosure, the first control signal line LC1 and the second control signal line LC2 are arranged in the same layer, and a shield line LP may be arranged between the first control signal line LC1 and the second control signal line LC2. Exemplarily, the shield line LP may be configured to receive the first level signal VGH or the second level signal VGL, so as to reduce the coupling between the first control signal line LC1 and the second control signal line LC2.

In some embodiments, the first control signal line LC1 has a first parasitic capacitance, the starting signal line STV has a second parasitic capacitance, and the first parasitic capacitance is smaller than the second parasitic capacitance. As a result, in the first stage S1, the first control signal transmitted by the first control signal line LC1 can be quickly transmitted to each of the multiple emission driving units 10, so that the row of sub-pixels electrically connected to each of the multiple emission driving units 10 can quickly enter a non-light-emitting state in the first stage S1 to avoid the flicker problem.

Figure 18:
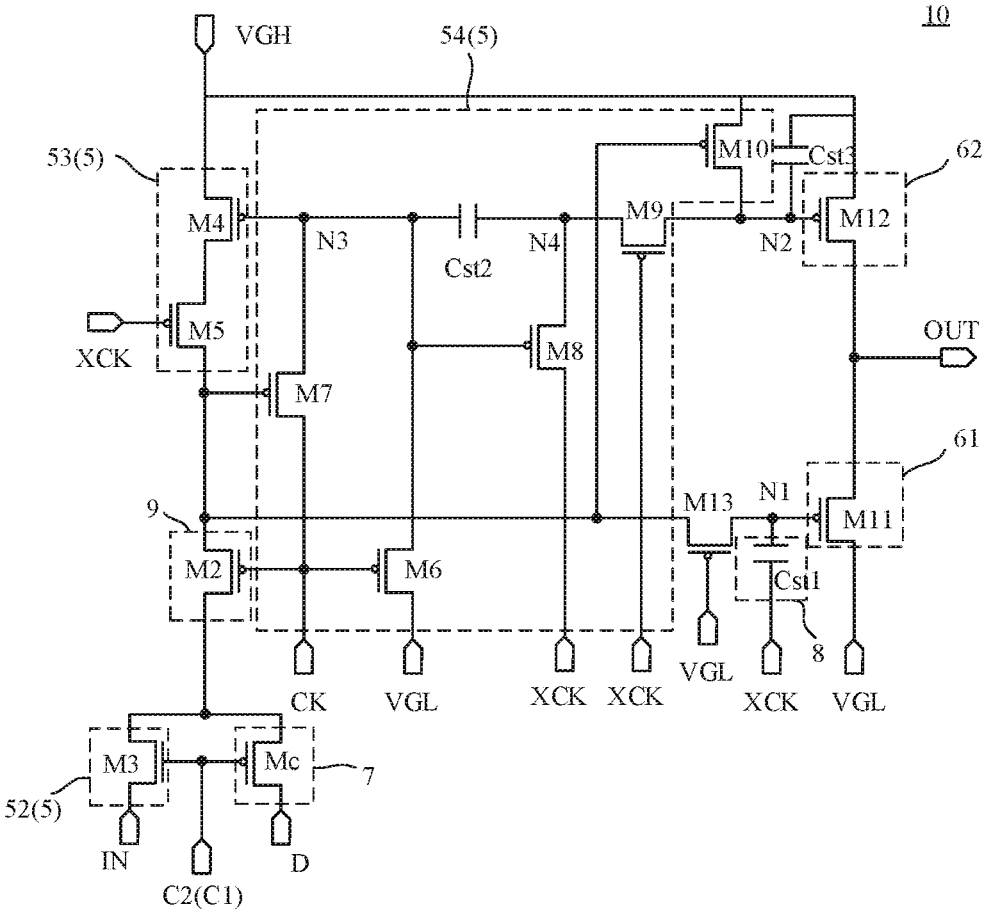
FIG. 18 is a schematic circuit diagram of an emission driving unit according to another embodiment of the present disclosure.

In some embodiments of the present disclosure, one of the control transistor Mc and the third transistor M3 may include a P-type transistor, and the other one of the control transistor Mc and the third transistor M3 may include an N-type transistor; and the first control signal terminal C1 is electrically connected to the second control signal terminal C2. As shown in FIG. 18 which is a schematic circuit diagram of an emission driving unit 10 according to another embodiment of the present disclosure, the control transistor Mc includes a P-type transistor, the third transistor M3 includes an N-type transistor, and the control electrode of the control transistor Mc and the control electrode of the third transistor M3 are electrically connected to each other. Such a configuration can reduce the number of signal lines in the display panel while ensuring that the control transistor Mc and the third transistor M3 are turned on in a time-divisional manner.

Exemplarily, in some embodiments of the present disclosure, a width-to-length ratio of a channel of the control transistor Mc may be greater than or equal to a width-to-length ratio of a channel of the first transistor M1. With such a configuration, the control transistor Mc can have a faster turn-on speed, and when the display panel enters the first stage S1, the control transistor Mc can be turned on quickly, so as to avoid the flicker problem.

Figure 19:
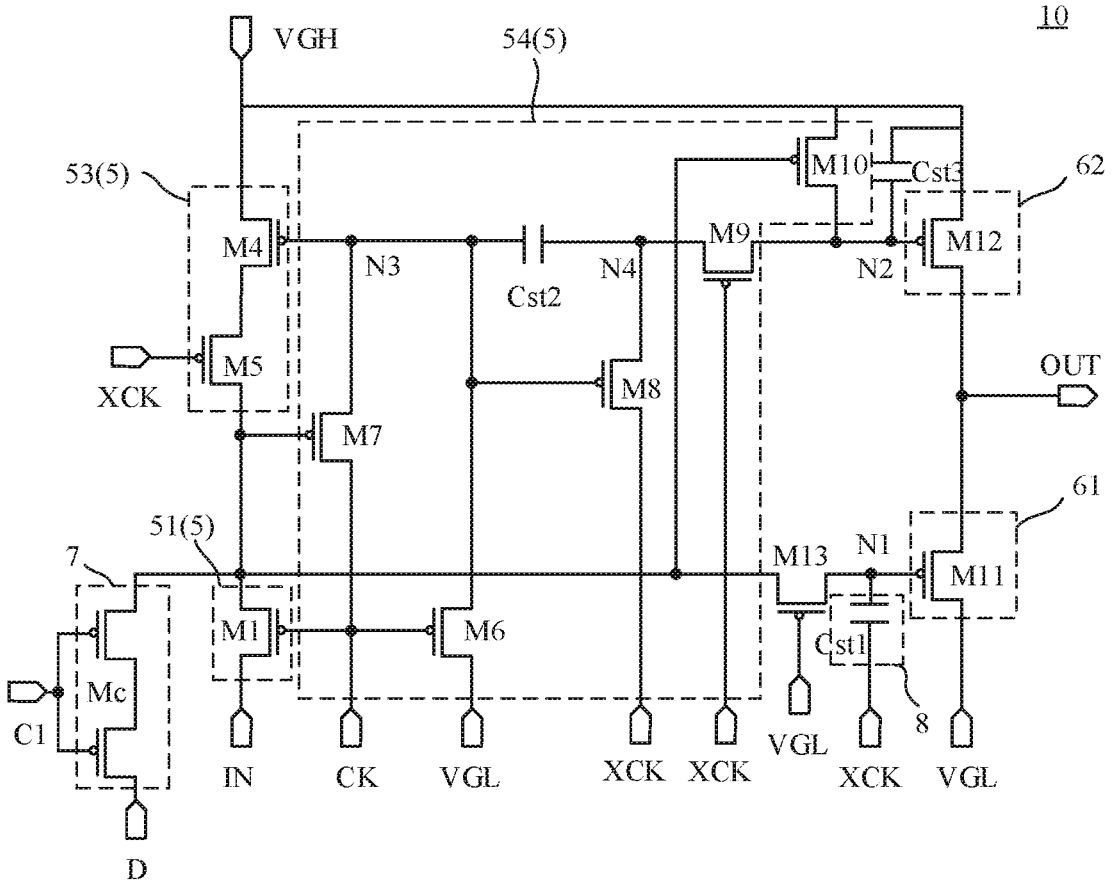
FIG. 19 is a schematic circuit diagram of an emission driving unit according to another embodiment of the present disclosure.

Exemplarily, as shown in FIG. 19 which is a schematic circuit diagram of an emission driving unit 10 according to another embodiment of the present disclosure, the control transistor Mc includes a double-gate transistor, so as to improve the stability of the control transistor Mc and reduce the risk of failure.

The present disclosure provides a method for driving the above display panel. As shown in FIG. 4, FIG. 5 and FIG. 6, an operating process of the display panel includes a first stage S1 and a second stage S2, and the method includes the following steps. In the first stage S1, the control transistor Mc is turned on, and the signal of the adjustment signal terminal D is provided to the first node N1 of the emission driving unit 10, so as to turn off the first output module 61, thereby preventing the emission driving unit 10 from outputting the active level that controls sub-pixels 4 to emit light.

In the second phase S2, the control transistor Mc is turned off.

In the method for driving the display panel provided by the embodiments of the present disclosure, by turning off the first output module 61 in the first stage S1, the flicker problem can be avoided, which is beneficial to ensuring the display effect of the display panel. Moreover, by turning off the control transistor Mc in the second stage S2, the signal of the adjustment signal terminal D is prevented from being supplied to the first node N1 in the second stage S2, which can make the signal of the first node N1 be independent of the signal of the adjustment signal terminal D in the second stage S2. In the second stage S2, under the action of the input terminal IN, the first clock signal terminal XCK, the second clock signal terminal CK, the first level signal terminal VGH and the second level signal terminal VGL, the emission driving unit 10 can provide a pulse signal (including an active level and an inactive level) to the light-emitting control signal line Emit through the output terminal OUT, so that the corresponding sub-pixels 4 can emit light with target brightness, and the display panel displays images.

In some embodiments, the adjustment signal terminal D is configured to transmit a pulse signal including a first level V1 . The first level V1 is configured to turn off the first output module 61. The method provided by the embodiments of the present disclosure further includes following steps.

During the display time of the frame image with the frequency of F, the signal transmitted by the start signal line STV is controlled to include at least N pulses, N*F≥240, so that the output signal of the emission driving unit includes N pulses in the display time of the frame image with the frequency of F, so that the signal output by the emission driving unit 10 can be switched between the active level and the inactive level at a relatively high frequency, and the output terminal OUT of the emission driving unit 10 can be prevented from continuously outputting the active level for a long time. When the emission driving unit 10 outputs an active level, the first node N1 of the emission driving unit 10 is at the active level capable of turning on the first output module 31. When the adjustment signal terminal D connected to the first electrode of the control transistor Mc constantly transmits an inactive level capable of turning off the first output module 31. Such a setting manner can shorten the duration in which the first electrode and the second electrode of the control transistor Mc are subjected to a large voltage difference, thereby improving the stability of the control transistor Mc.

Exemplarily, the method further includes: controlling a duty ratio of an active level of the output signal of the emission driving unit 10 to be smaller than or equal to a first preset value. Under the action of the active level, the corresponding sub-pixel 4 emits light. With such a configuration, a constant duration in which the emission driving unit 10 outputs the active level can be smaller than or equal to the preset duration, and thus the constant duration in which a large voltage difference is kept between the first electrode and the second electrode of the control transistor Mc can be shortened, thereby improving the stability of the control transistor Mc.

Exemplarily, as shown in FIG. 5, the emission driving unit 10 further includes a bootstrap module 8. The bootstrap module 8 has a first terminal electrically connected to the first node N1, and a second terminal electrically connected to the first clock signal terminal XCK. The method provided by the embodiments of the present disclosure further includes: controlling a duty ratio of the active level transmitted by the first clock signal terminal XCK to be smaller than or equal to a second preset value. Exemplarily, as shown in FIG. 5, the bootstrap module 8 includes a first capacitor Cst1. As mentioned above, when the emission driving unit 10 operates, in the first sub-period t21 shown in FIG. 7, the first node N1 is at a low-level, and the low-level is equal to the signal provided by the second level signal terminal VGL. In the second sub-period t22, when the signal provided by the first clock signal terminal XCK is switched from a high-level to a low-level, the potential of the first node N1 can be pulled to a third level lower than the second level under the bootstrap action of the bootstrap module 8. Until the signal provided by the first clock signal terminal XCK is switched from a low-level to a high-level, the potential of the first node N1 will be pulled up from the third level to the second level. When the first node N1 is at the third level, if the voltage of the first electrode of the control transistor Mc is large, the control transistor Mc will be subjected to a large voltage drop. In some embodiments of the present disclosure, by shortening the constant duration in which the first clock signal terminal XCK is kept at a low-level, the constant duration in which the potential of the first node N1 is kept at the third level can be shortened, so that the constant duration in which the second electrode of the control transistor Mc electrically connected to the first node N1 is kept at the third level is shortened, thereby improving the stability of the control transistor Mc.

Figure 20:
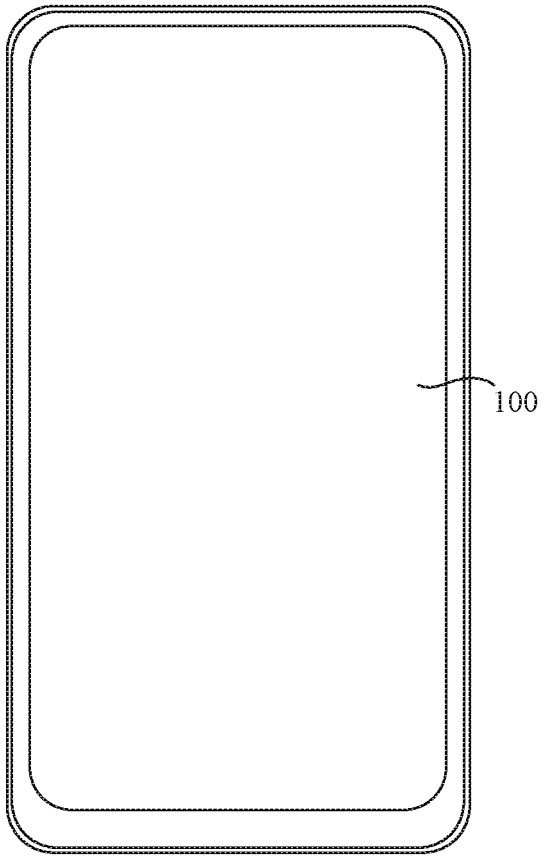
FIG. 20 is a schematic diagram of a display apparatus according to an embodiment of the present disclosure.

The present disclosure further provides a display apparatus. As shown in FIG. 20 which is a schematic diagram of a display apparatus according to an embodiment of the present disclosure, the display apparatus includes the display panel 100 mentioned above. The specific structure of the display panel 100 has been described in detail in the above embodiments, which will not be elaborated here. It is appreciated that the display apparatus shown in FIG. 20 is only a schematic illustration, and the display apparatus can be any electronic device with a display function, such as a mobile phone, a tablet computer, a laptop computer, an electronic paper book, or a television.

In the display panel provided by the embodiments of the present disclosure, the control module is arranged in the emission driving unit of the display panel, and the control module may adjust the operating state of the first output module. For example, when the display panel is started up and before the displaying of the first frame of image starts, or after the display panel is shutdown, the control module can provide the signal of the adjustment signal terminal to the first node in response to the signal of the first control signal terminal, and the signal of the adjustment signal terminal can turn off the first output module, thereby preventing the signal of the second level signal terminal electrically connected to the first output module from being outputted to the pixel driving circuit, and avoiding the light-emitting of the sub-pixel. That is, by using the display panel provided by the embodiments of the present disclosure, the flicker problem of the display panel when starting up can be effectively avoided, and the display effect of the display panel is improved.

Moreover, in the embodiments of the present disclosure, by designing the control transistor in the control module, the voltage difference between any two of the control electrode, the first electrode or the second electrode of the control transistor is smaller than or equal to a preset threshold, and/or, the duration in which the voltage difference between any two of the control electrode, the first electrode or the second electrode of the control transistor is greater than the preset threshold is smaller than or equal to a preset duration, so that the control transistor is prevented from being in a large bias state for a long time, thereby ensuring the stability of the control transistor.

The above are merely preferred embodiments of the present disclosure, which, as mentioned above, are not configured to limit the present disclosure. Whatever within the principles of the present disclosure, including any modification, equivalent substitution, improvement, etc., shall fall into the protection scope of the present disclosure.

What is claimed is:

1. A display panel, comprising: an emission driving circuit, wherein the emission driving circuit comprises a plurality of emission driving units that is cascaded, wherein each of the plurality of emission driving units comprises:

an input terminal, an output terminal, a first clock signal terminal, a second clock signal terminal, a first level signal terminal, a second level signal terminal, a first node, a second node, an adjustment signal terminal, and a first control signal terminal;

a processing module electrically connected to the input terminal, the first clock signal terminal, the second clock signal terminal, the first level signal terminal, the second level signal terminal, the first node and the second node, and the processing module being configured to provide a signal to the first node and a signal to the second node in response to a signal of the first clock signal terminal and a signal of the second clock signal terminal;

a first output module electrically connected to the first node, the second level signal terminal and the output terminal, and the first output module being configured to transmit a signal of the second level signal terminal to the output terminal in response to the signal of the first node; and a control module comprising a control transistor, wherein the control transistor has a control electrode electrically connected to the first control signal terminal, a first electrode electrically connected to the adjustment signal terminal, and a second electrode electrically connected to the first node;

the control transistor is configured to transmit a signal of the adjustment signal terminal to the first node in response to a signal of the first control signal terminal, so as to turn off the first output module; and a voltage difference between any two of the control electrode, the first electrode or the second electrode of the control transistor is smaller than or equal to a preset threshold; or a constant duration in which the voltage difference between any two of the control electrode, the first electrode or the second electrode of the control transistor is kept greater than the preset threshold is smaller than or equal to a preset duration.

2. The display panel according to claim 1, wherein the adjustment signal terminal is configured to transmit a pulse signal comprising a first level, and the first level is configured to turn off the first output module.

3. The display panel according to claim 2, wherein the emission driving circuit further comprises a start signal line electrically connected to the input terminal of a first-stage emission driving unit of the plurality of emission driving units, and the start signal line is further electrically connected to the adjustment signal terminal.

4. The display panel according to claim 1, wherein the signal provided by the adjustment signal terminal is a constant signal, and the constant signal is configured to turn off the first output module.

5. The display panel according to claim 1, wherein during a display time of a frame image with a frequency F, an output signal of the emission driving unit comprises at least N pulses, where $N*F \geq 240$.

6. The display panel according to claim 5, wherein each of the plurality of emission driving units further comprises a start signal line electrically connected to the input terminal of a first-stage emission driving unit of the plurality of emission driving units, and during the display time of the frame image with the frequency F, a signal transmitted by the start signal line comprises at least N pulses, where $N*F \geq 240$.

7. The display panel according to claim 1, wherein a duty ratio of an active level of an output signal of each of the plurality of emission driving units is smaller than or equal to a first preset value, and wherein the first preset value is smaller than or equal to 99%.

8. The display panel according to claim 1, wherein each of the plurality of emission driving units further comprises a bootstrap module, the bootstrap module has a first electrode connected to the first node, and a second electrode electrically connected to the first clock signal terminal, and a duty ratio of an active level transmitted by the first clock signal terminal is smaller than or equal to a second preset value, and where the second preset value is smaller than or equal to 40%.

9. The display panel according to claim 1, wherein a potential of an inactive voltage transmitted by the first control signal terminal is $V_{C2}$; a potential of an inactive voltage transmitted by the adjustment signal terminal is $V_{S2}$; and the inactive voltage transmitted by the adjustment signal terminal is configured to turn off the first output module; where $|V_{C2}| \geq |V_{S2}|$.

10. The display panel according to claim 1, wherein the processing module comprises a first processing unit electrically connected to the first node, the first processing unit comprises a first transistor, wherein the first transistor has a control electrode electrically connected to the second clock signal terminal, a first electrode electrically connected to the input terminal, and a second electrode electrically connected to the first node; and a width to length ratio of a channel of the control transistor is greater than or equal to a width to length ratio of a channel of the first transistor;

or wherein the control transistor is a double-gate transistor.

11. The display panel according to claim 1, wherein each of the plurality of emission driving units further comprises a protection module, the protection module has a first terminal electrically connected to the control transistor, and a second terminal electrically connected to the first node, and the protection module is configured to electrically connect the first node and the control transistor in response to the signal of the second clock signal terminal.

12. The display panel according to claim 11, wherein the protection module comprises a second transistor, and wherein the second transistor has a control electrode electrically connected to the second clock signal terminal, a first electrode electrically connected to the control transistor, and a second electrode electrically connected to the first node.

13. The display panel according to claim 11, wherein the processing module further comprises a second processing unit, the second processing unit has a first terminal electrically connected to the input terminal, and a second terminal electrically connected to the first terminal of the protection module; and the second processing unit is configured to provide the signal of the input terminal to the protection module in response to a signal of a second control signal terminal.

14. The display panel according to claim 13, further comprising a first control signal line, a second control signal line and an adjustment signal line, wherein the control electrode of the control transistor is electrically connected to the first control signal line, and the first electrode of the control transistor is electrically connected to the adjustment signal line; and the second processing unit comprises a third transistor, and the third transistor has a control electrode electrically connected to the second control signal line, a first electrode electrically connected to the input terminal, and a second electrode electrically connected to the protection module.

15. The display panel according to claim 14, wherein the first control signal line and the second control signal line are arranged in different layers, and along a direction perpendicular to a plane of the display panel, the first control signal line does not overlap with the second control signal line;

or wherein the first control signal line and the second control signal line are arranged in a same layer, and a distance between the first control signal line and the second control signal line is greater than 3 μm;

or wherein a shield line is provided between the first control signal line and the second control signal line.

16. The display panel according to claim 14, wherein the emission driving circuit further comprises a start signal line electrically connected to the input terminal of a first-stage emission driving unit; and the first control signal line has a first parasitic capacitance, the start signal line has a second parasitic capacitance, and the first parasitic capacitance is smaller than the second parasitic capacitance.

17. The display panel according to claim 13, wherein the second processing unit comprises a third transistor, the third transistor has a control electrode electrically connected to the second control signal terminal, a first electrode electrically connected to the input terminal, and a second electrode electrically connected to the protection module; and one of the control transistor and the third transistor comprises a P-type transistor, and the other of the control transistor and the third transistor comprises an N-type transistor; and the first control signal terminal is electrically connected to the second control signal terminal.

18. The display panel according to claim 1, wherein the processing module further comprises:

a pull-down unit electrically connected to the first level signal terminal, a third node, the first clock signal terminal and the first node, wherein the pull-down unit is configured to provide a signal of the first level signal terminal to the first node in response to the signal of the first clock signal terminal and a signal of the third node; and a pull-up unit electrically connected to the first node, the second node, the third node, the first level signal terminal, the first clock signal terminal, and the second clock signal terminal, wherein the pull-up unit is configured to transmit a voltage signal to the second node in response to the signal of the second clock signal terminal, the signal of the first node, the signal of the third node and the signal of the first clock signal terminal;

wherein each of the plurality of emission driving units further comprises: a second output module electrically connected to the second node, the first level signal terminal and the output terminal, and wherein the second output module is configured to electrically connect the first level signal terminal and the output terminal in response to the signal of the second node.

19. The display panel according to claim 18, wherein the pull-down unit comprises a fourth transistor and a fifth transistor;

wherein the fourth transistor has a control electrode electrically connected to the third node, a first electrode electrically connected to the first level signal terminal, and a second electrode electrically connected to a first electrode of the fifth transistor; and the fifth transistor has a control electrode electrically connected to the first clock signal terminal, and a second electrode electrically connected to the first node;

wherein the pull-up unit comprises:

a sixth transistor, having a control electrode electrically connected to the second clock signal terminal, a first electrode electrically connected to the second level signal terminal, and a second electrode electrically connected to the third node;

a seventh transistor, having a control electrode electrically connected to the first node, a first electrode electrically connected to the second clock signal terminal, and a second electrode electrically connected to the third node;

an eighth transistor, having a control electrode electrically connected to the third node, a first electrode electrically connected to the first clock signal terminal, and a second electrode;

a ninth transistor, having a control electrode electrically connected to the first clock signal terminal, a first electrode electrically connected to the second electrode of the eighth transistor, and a second electrode electrically connected to the second node; and a tenth transistor, having a control electrode electrically connected to the first node, a first electrode electrically connected to the first level signal terminal, and a second electrode electrically connected to the second node;

wherein the first output module comprises an eleventh transistor having: a control electrode electrically connected to the first node, a first electrode electrically connected to the second level signal terminal, and a second electrode electrically connected to the output terminal;

wherein the second output module comprises a twelfth transistor having a control electrode electrically connected to the second node, a first electrode electrically connected to the first level signal terminal, and a second electrode electrically connected to the output terminal;

wherein each of the plurality of emission driving units further comprises:

a first capacitor having a first plate electrically connected to the first node, and a second plate electrically connected to the first clock signal terminal;

a second capacitor having a first plate electrically connected to the third node, and a second plate electrically connected to the second electrode of the eighth transistor; and a third capacitor having a first plate electrically connected to the second level signal terminal, and a second plate electrically connected to the second node.

20. A method for driving a display panel according to claim 1, wherein an operating process of the display panel comprises a first stage and a second stage, and the method comprises:

in the first stage, controlling the control transistor to be turned on, and providing the signal of the adjustment signal terminal to the first node; and in the second phase, controlling the control transistor to be turned off.

21. The method according to claim 20, wherein the signal of the adjustment signal terminal is a pulse signal comprising a first level, and the first level is configured to turn off the first output module;

the emission driving circuit further comprises a start signal line electrically connected to the input terminal of a first-stage emission driving unit of the plurality of emission driving units; and the method further comprises: controlling a signal transmitted by the start signal line to comprise at least N pulses within the display time of a frame image with a frequency F, where $N*F \geq 240$;

or wherein the method further comprises: controlling a duty ratio of an active level of an output signal of each of the plurality of emission driving units to be smaller than or equal to a first preset value;

or wherein each of the plurality of emission driving units further comprises a bootstrap module, the bootstrap module has a first terminal connected to the first node, and a second terminal electrically connected to the first clock signal terminal; and the method further comprises: controlling a duty ratio of an active level transmitted by the first clock signal terminal to be smaller than or equal to a second preset value.

22. A display apparatus, comprising a display panel, wherein the display panel comprises an emission driving circuit, and the emission driving circuit comprises a plurality of emission driving units that is cascaded, wherein each of the plurality of emission driving units comprises:

an input terminal, an output terminal, a first clock signal terminal, a second clock signal terminal, a first level signal terminal, a second level signal terminal, a first node, a second node, an adjustment signal terminal, and a first control signal terminal;

a processing module electrically connected to the input terminal, the first clock signal terminal, the second clock signal terminal, the first level signal terminal, the second level signal terminal, the first node and the second node, and the processing module being configured to provide a signal to the first node and a signal to the second node in response to a signal of the first clock signal terminal and a signal of the second clock signal terminal;

a first output module electrically connected to the first node, the second level signal terminal and the output terminal, and the first output module being configured to transmit a signal of the second level signal terminal to the output terminal in response to the signal of the first node; and a control module comprising a control transistor, wherein the control transistor has a control electrode electrically connected to the first control signal terminal, a first electrode electrically connected to the adjustment signal terminal, and a second electrode electrically connected to the first node;

the control transistor is configured to transmit a signal of the adjustment signal terminal to the first node in response to a signal of the first control signal terminal, so as to turn off the first output module; and a voltage difference between any two of the control electrode, the first electrode or the second electrode of the control transistor is smaller than or equal to a preset threshold, or a duration in which the voltage difference between any two of the control electrode, the first electrode or the second electrode of the control transistor is constantly greater than the preset threshold is smaller than or equal to a preset duration.

* * * * *